US010950946B2

(12) United States Patent
Yamamoto

(10) Patent No.: US 10,950,946 B2
(45) Date of Patent: Mar. 16, 2021

(54) ANTENNA, MODULE SUBSTRATE, AND MODULE

(71) Applicant: KYOCERA Corporation, Kyoto (JP)

(72) Inventor: Daisuke Yamamoto, Kizugawa (JP)

(73) Assignee: KYOCERA Corporation, Kyoto (JP)

( * ) Notice: Subject to any disclaimer, the term of this patent is extended or adjusted under 35 U.S.C. 154(b) by 0 days.

(21) Appl. No.: 16/463,715

(22) PCT Filed: Nov. 24, 2017

(86) PCT No.: PCT/JP2017/042270
§ 371 (c)(1),
(2) Date: May 23, 2019

(87) PCT Pub. No.: WO2018/101174
PCT Pub. Date: Jun. 7, 2018

(65) Prior Publication Data

US 2019/0326677 A1 Oct. 24, 2019

(30) Foreign Application Priority Data

Nov. 30, 2016 (JP) ..... JP2016-233184

(51) Int. Cl.
*H01Q 9/16* (2006.01)

(52) U.S. Cl.
CPC ..... *H01Q 9/16* (2013.01)

(58) Field of Classification Search
None
See application file for complete search history.

(56) References Cited

U.S. PATENT DOCUMENTS

2002/0089456 A1* 7/2002 Hamada ..... H01Q 9/0442 343/702
2007/0216594 A1* 9/2007 Uno ..... H01Q 21/064 343/700
2011/0248724 A1* 10/2011 Sekiguchi ..... H01Q 9/265 324/633
2012/0086526 A1* 4/2012 Kato ..... H01Q 1/2225 333/24 R (Continued)

FOREIGN PATENT DOCUMENTS

JP 2011-222833 A 11/2011
WO 2005/122332 A1 12/2005
WO 2009/038739 A1 3/2009

*Primary Examiner* — Crystal L Hammond
(74) *Attorney, Agent, or Firm* — Procopio Cory Hargreaves and Savitch LLP

(57) ABSTRACT

An antenna includes a first main conductor, a second main conductor, a first facing conductor, and a second facing conductor. The first main conductor includes a first end part and a second end part which is located on one side of a first direction relative to the first end part. The second main conductor includes a third end part adjacent to the first end part and a fourth end part which is located on the other side of the first direction relative to the third end part. The first facing conductor faces the first main conductor in a second direction intersecting with the first direction. The second facing conductor faces the second main conductor in the second direction. A pair of the facing conductors include portions outside a pair of the main conductors in the first direction.

18 Claims, 11 Drawing Sheets

(56) References Cited

U.S. PATENT DOCUMENTS

2014/0203981 A1* 7/2014 Nakano ..... H01Q 9/0407
343/749
2015/0034825 A1* 2/2015 Debray ..... G01J 5/10
250/332

* cited by examiner

ANTENNA, MODULE SUBSTRATE, AND MODULE

TECHNICAL FIELD

The present disclosure relates to an antenna, a module substrate, and a module.

BACKGROUND ART

As an antenna for transmitting/receiving radio waves, there are known a dipole antenna and antennas similar to the dipole antenna (for example Patent Literature 1 and 2). The dipole antenna has a pair of antenna conductors extending from positions adjacent to each other toward inverse directions to each other.

The antenna in Patent Literature 1 has first and second conductive elements extending from end parts which are adjacent to each other toward reverse directions to each other and third and fourth conductive elements facing them. The first and second conductive elements and the third and fourth conductive elements are respectively connected to each other at the end parts on the outer sides of them (end parts which are most distant from each other). That is, Patent Literature 1 discloses an antenna similar to a so-called "folded dipole antenna".

The antenna in Patent Literature 2 has a disk-shaped pair of conductors arranged in a surface direction (diameter direction) and disk-shaped pair of conductors facing the former pair of conductors. The conductors facing each other are connected to each other by a plurality of conductors arranged along the circumference.

CITATION LIST

Patent Literature

Patent Literature 1: Japanese Patent Publication No. 2011-222833

Patent Literature 2: International Patent Publication No. 2005/122332

SUMMARY OF INVENTION

An antenna according to one aspect of the present disclosure includes a first main conductor, a second main conductor, a first facing conductor, and a second facing conductor. The first main conductor includes a first end part and a second end part which is located on one side of a first direction relative to the first end part. The second main conductor includes a third end part adjacent to the first end part and a fourth end part which is located on the other side of the first direction relative to the third end part. The first facing conductor faces the first main conductor in a second direction intersecting with the first direction. The second facing conductor faces the second main conductor in the second direction. The first facing conductor includes a portion which is closer to the one side of the first direction than the first main conductor. The second facing conductor includes a portion which is closer to the other side of the first direction than the second main conductor.

An antenna according to one aspect of the present disclosure includes a first main conductor, a second main conductor, a first facing conductor, a second facing conductor, at least one first connection conductor, at least one second connection conductor, a plate-shaped conductor, and a line conductor. The first main conductor includes a first end part and a second end part which is located on one side of a first direction relative to the first end part. The second main conductor includes a third end part adjacent to the first end part and a fourth end part which is located on the other side of the first direction relative to the third end part. The first facing conductor faces the first main conductor in a second direction intersecting with the first direction. The second facing conductor faces the second main conductor in the second direction. The at least one first connection conductor connects the first main conductor and the first facing conductor. The at least one second connection conductor connects the second main conductor and the second facing conductor. The plate-shaped conductor is connected to one of the first and second main conductors. The line conductor is connected to the other of the first and second main conductors, faces the plate-shaped conductor, and extends along the plate-shaped conductor. Each of the first and second main conductors and the first and second facing conductors includes a shape with the first direction as a long direction. The at least one first connection conductor includes one which is separated from ends in the first direction of the first facing conductor. The at least one second connection conductor includes one which is separated from two ends in the first direction of the second facing conductor.

An antenna according to one aspect of the present disclosure includes a first main conductor, a second main conductor, a first facing conductor, a second facing conductor, a plurality of first connection conductors, and a plurality of second connection conductors. The first main conductor includes a first end part and a second end part which is located on one side of a first direction relative to the first end part. The second main conductor includes a third end part adjacent to the first end part and a fourth end part which is located on the other side of the first direction relative to the third end part. The first facing conductor faces the first main conductor in a second direction intersecting with the first direction. The second facing conductor faces the second main conductor in the second direction. The plurality of first connection conductors connect the first main conductor and the first facing conductor. The plurality of second connection conductors connect the second main conductor and the second facing conductor. Each of the first and second main conductors and the first and second facing conductors includes a shape with the first direction as a long direction. The plurality of first connection conductors are different from each other in positions in the first direction. The plurality of second connection conductors are different from each other in positions in the first direction.

An antenna according to one aspect of the present disclosure includes a first main conductor, a second main conductor, a first facing conductor, a second facing conductor, a first expansion conductor, and a second expansion conductor. The first main conductor includes a first end part and a second end part which is located on one side of a first direction relative to the first end part. The second main conductor includes a third end part adjacent to the first end part and a fourth end part which is located on the other side of the first direction relative to the third end part. The first facing conductor faces the first main conductor in a second direction intersecting with the first direction. The second facing conductor faces the second main conductor in the second direction. The first expansion conductor is located closer to one side of a third direction intersecting with the first and second directions than the first main conductor and the first facing conductor. The second expansion conductor is located closer to the one side of the third direction than the second main conductor and the second facing conductor.

A module substrate according to one aspect of the present disclosure includes the antenna described above, an insulation substrate including a dielectric, and a land on a surface of the insulation substrate.

A module according to one aspect of the present disclosure includes the module substrate described above and an electronic part mounted on the land.

DESCRIPTION OF EMBODIMENTS

Figure 1:
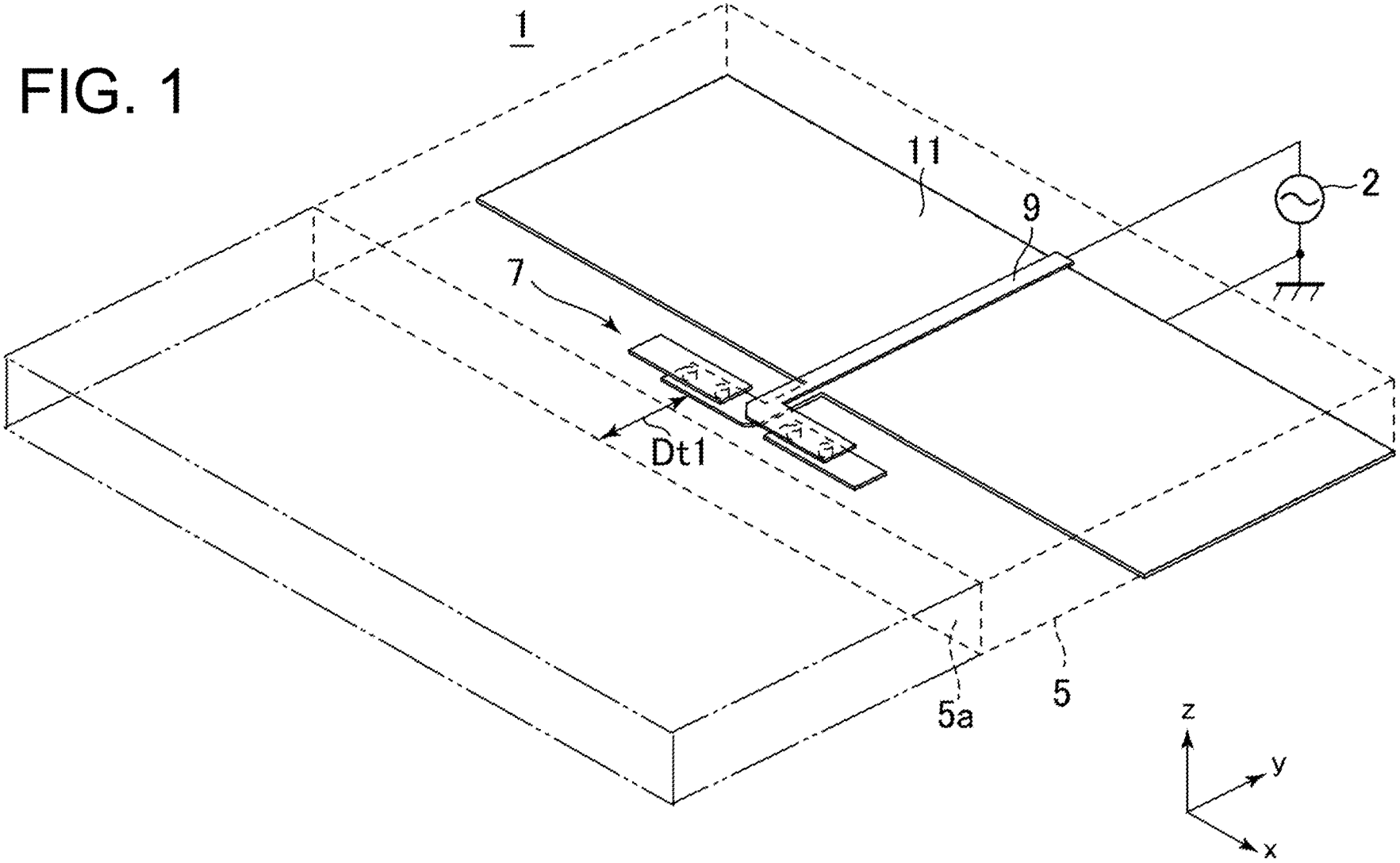
FIG. 1 is a perspective view showing an overall configuration of an antenna according to a first embodiment.

Below, embodiments according to the present disclosure will be explained with reference to the drawings. Note that, the drawings used in the following explanation are schematic ones. Size ratios etc. in the drawings do not always coincide with the actual ones.

Further, for convenience, sometimes an orthogonal coordinate system xyz will be attached to the drawings and will be referred to. In the antenna, any direction may be defined as "above" or "below". However, for convenience, sometimes the "upper surface" or "lower surface" or other term will be used where the positive side of the z-direction is the upper part.

In explanation of the second and following embodiments, regarding the configurations which are the same as or similar to the configurations in the previously explained embodiments, notations attached to the configurations in the previously explained embodiments will be used, and sometimes explanations will be omitted. Note that, even in a case where notations which are different from the notations attached to the configurations in the previously explained embodiments are attached to the configurations corresponding (similar) to the configurations in the previously explained embodiments, items which are not particularly referred to are the same as those in the previously explained embodiments.

In configurations which are similar to each other, like with the "first main conductor 13A" and "second main conductor 13B", sometimes mutually different numbers ("first" and "second") and additional notations ("A", "B") comprised of capital letters which are different from each other will be attached with respect to the same terms. Further, in this case, sometimes they will be simply referred to as the "main conductors 13" and will not be differentiated.

First Embodiment (Overall Configuration of Antenna)

FIG. 1 is a perspective view showing the overall configuration of an antenna 1. In this view, a symbol (2) indicating a power supply is shown in order to clearly show the potential of the antenna 1. Note that, in actuality, for example, an IC (integrated circuit) 3 (FIG. 11B) is connected to the antenna 1.

The antenna 1 is similar to a dipole antenna having a length in accordance with the wavelength in an x-direction. Accordingly, the antenna 1 is provided for emission and/or reception of radio waves of linear polarization having the x-direction as the direction of vibration of an electric field. However, the antenna 1 can also handle circular polarization (linear component in that). The frequency band in which the antenna 1 is utilized is any band.

The size of the antenna 1 may be suitably set in accordance with the wavelength etc. of the frequency band in which the antenna 1 is utilized. In the following explanation, a case where the antenna 1 is a relatively small one utilized in a relatively high frequency band will be taken as an example. For example, the length of one side when viewed on a plane of the rectangular shape indicated by the dotted lines (antenna substrate 5) is 1 mm to 10 mm, and the thickness indicated by the dotted lines is 0.1 mm to 1 mm.

The antenna 1 is for example provided with an antenna substrate 5 (one example of dielectric) configured by a dielectric (insulator) and with an antenna conductor 7, a line conductor 9 (transmission line), and a plate-shaped conductor 11 which are all configured by conductors provided on the antenna substrate 5.

The plate-shaped conductor 11 is given a reference potential. That is, the plate-shaped conductor 11 plays the role as the ground. When emitting radio waves, the IC 3 transmits a signal having a potential difference relative to the potential given to the plate-shaped conductor 11 to the line conductor 9 (supplies power to the line conductor 9). The antenna conductor 7 converts the signal (current) from the line conductor 9 to a radio wave and emits the result. Further, when receiving a radio wave, the antenna conductor 7 converts the radio wave to a current. This current is input as a signal having a potential difference from the reference potential given to the plate-shaped conductor 11 through the line conductor 9 to the IC 3.

The antenna substrate 5 is for example a substantially plate-shaped member. The planar shape thereof may be a suitable one. The antenna substrate 5 may be configured by a single material or may be configured by a plurality of materials. When it is configured by a plurality of materials, for example, the antenna substrate 5 may include a portion formed by stacking dielectric layers made of different materials in the thickness direction and/or may include a portion formed by impregnating a dielectric into a base material made of glass fabric or the like. The dielectric of the antenna substrate 5 is for example a ceramic and/or resin. The antenna substrate 5 for example contributes to holding of the antenna conductor 7, line conductor 9, and plate-shaped conductor 11 and contributes to shortening of the wavelength of the radio wave by being configured by a dielectric in at least the portion contacting the antenna conductor 7.

The materials for the antenna conductor 7, line conductor 9, and plate-shaped conductor 11 are for example metal. The metal may be a suitable one such as Cu or Al. The antenna conductor 7, line conductor 9, and plate-shaped conductor 11 may be configured by the same materials as each other or may be configured by different materials from each other. Each of the antenna conductor 7, line conductor 9, and plate-shaped conductor 11 may be configured by a single material or may be configured by a plurality of materials. When it is configured by a plurality of materials, for example, each portion may be configured by stacking conductor layers made of mutually different metals in the thickness direction (z-direction) of the antenna substrate 5.

Parts of the antenna conductor 7 and the line conductor 9 are for example buried in the antenna substrate 5. The other parts of the antenna conductor 7 and the plate-shaped conductor 11 are for example positioned at the lower surface of the antenna substrate 5. The line conductor 9 and plate-shaped conductor 11 are for example separated from the antenna conductor 7 in the surface direction (y-direction) of the antenna substrate 5. The line conductor 9 and the plate-shaped conductor 11 for example face each other in the thickness direction (z-direction) of the antenna substrate 5.

By the line conductor 9 and the plate-shaped conductor 11 facing each other, a so-called microstrip line is configured. The distance between the line conductor 9 and the plate-shaped conductor 11 is for example constant. The shape of the line conductor 9 may be suitably set. In the example in FIG. 1, the line conductor 9 is configured by a layered pattern parallel to the antenna substrate 5 and linearly extends with a constant width. The shape of the plate-shaped conductor 11 may also be suitably set. In the example in FIG. 1, the plate-shaped conductor 11 is configured by a layered pattern parallel to the antenna substrate 5 and is plate-shaped so as to have a relatively broad area compared with the antenna conductor 7 and line conductor 9. The dimensions of each of the line conductor 9 and plate-shaped conductor 11 and the distance between the two may be suitably set in accordance with the frequency band in which the antenna 1 is utilized, and the like.

Note that, in the above explanation, the antenna 1 is defined including the line conductor 9 and plate-shaped conductor 11. However, the antenna 1 may be defined by only the antenna conductor 7 and a portion in the antenna substrate 5 on the periphery of the antenna conductor 7 as well.

(Overall Configuration of Antenna Conductor)

Figure 2A:
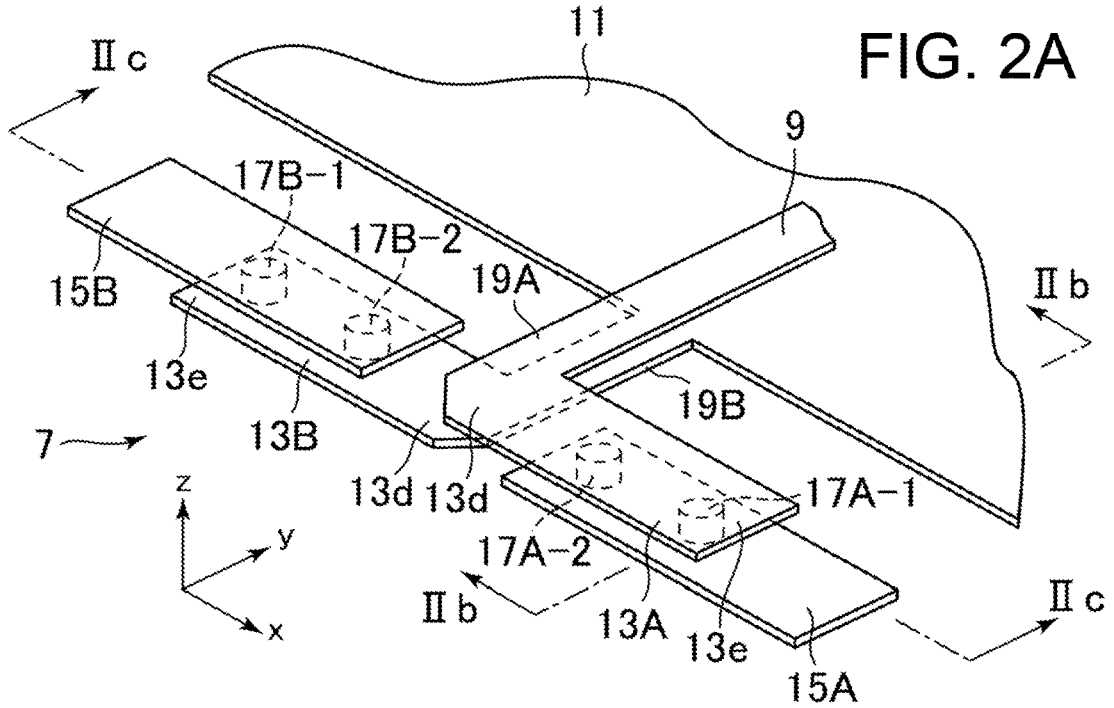
FIG. 2A is an enlarged view of a portion in FIG. 1.
Figure 2B:
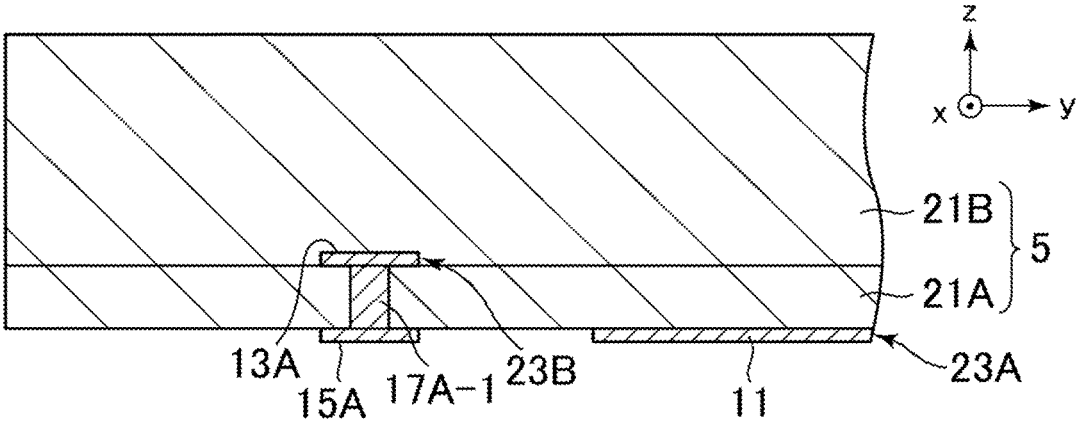
FIG. 2B is a cross-sectional view taken along the IIb-IIb line in FIG. 2A.
Figure 2C:
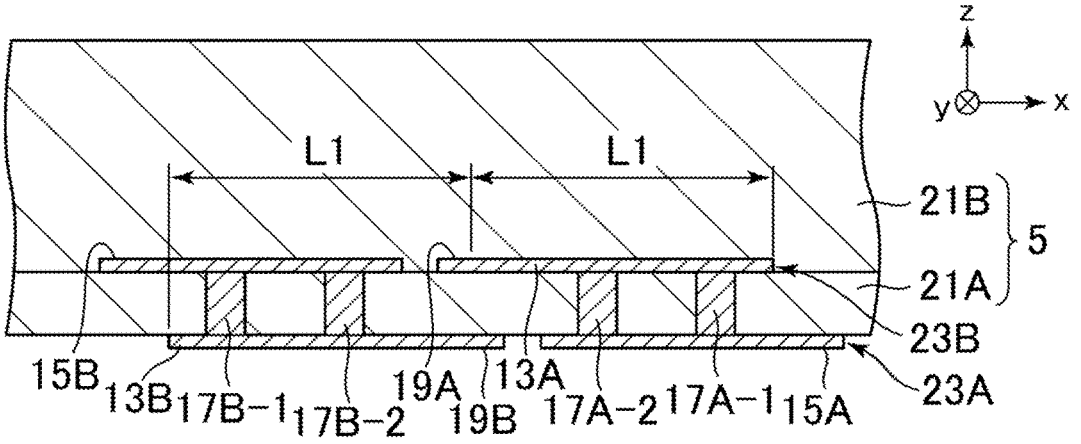
FIG. 2C is a cross-sectional view taken along the IIc-IIc line in FIG. 2A.

FIG. 2A is a perspective view showing a portion including the antenna conductor 7 in the antenna 1 in an enlarged manner. FIG. 2B is a cross-sectional view taken along the IIb-IIb line in FIG. 2A. FIG. 2C is a cross-sectional view taken along the IIc-IIc line in FIG. 2A. Note that, in FIG. 2A, illustration of the antenna substrate 5 is omitted.

The antenna conductor 7 has for example a pair of main conductors 13 (13A and 13B), a pair of facing conductors 15 (15A and 15B) facing the former, and a plurality of connection conductors 17 (17A-1, 17A-2, 17B-1, and 17B-2) connecting the former and the latter. Between the antenna conductor 7 and both of the line conductor 9 and plate-shaped conductor 11, a pair of connection lines 19 (19A and 19B) for connecting each two are provided.

The antenna conductor 7 is for example shaped substantially rotation symmetrically by 180° about a not shown symmetrical axis which is parallel to the y-direction. That is, the first main conductor 13A and the second main conductor 13B are positioned and shaped substantially rotation symmetrically by 180° relative to each other. The first facing conductor 15A and the second facing conductor 15B are positioned and shaped substantially rotation symmetrically by 180° relative to each other. The first connection conductor 17A (17A-1 and 17A-2) and the second connection conductor 17B (17B-1 and 17B-2) are positioned and shaped substantially rotation symmetrically by 180° relative to each other. Also the pair of connection lines 19 are for example substantially shaped rotation symmetrically by 180° about a not shown symmetrical axis which is parallel to the y-direction.

The pair of main conductors 13 are configurations forming the basis for the antenna conductor 7 functioning as if it were a dipole antenna. Further, due to provision of the pair of facing conductors 15 and plurality of connection conductors 17, for example, a gain relating to circular polarization of the antenna conductor 7 is improved. The specific configurations of these are for example as follows.

(Main Conductors)

The pair of main conductors 13 have lengths L1 (FIG. 2C) from the positions where they are adjacent to each other toward reverse sides to each other in the x-direction. In other words, as indicated by notations in FIG. 2A, the first main conductor 13A has an end part 13*d* and an end part 13*e* which is positioned on the positive side of the x-direction relative to this end part 13*d*, while the second main conductor 13B has an end part 13*d* which is adjacent with respect to the end part 13*d* in the first main conductor 13A and an end part 13*e* which is positioned on the negative side of the x-direction relative to the end part 13*d* in the second main conductor 13B.

Each of the pair of main conductors 13 is for example connected with each of the pair of connection lines 19 in the end part 13*d* of the end part on the side where they are adjacent to each other. The length L1 is made substantially ¼ of the wavelength of the radio wave covered by transmission and/or reception. Consequently, the length of the pair of main conductors 13 as a whole (L1+L2) in the x-direction is set to substantially a half wavelength. Due to such a configuration, the pair of main conductors 13 are configured similar to a half wavelength dipole antenna.

Note that, the length of the pair of conductors (here, pair of main conductors 13) in the half wavelength dipole antenna is ¼ wavelength in principle. In actuality, however, it may be made shorter than the ¼ wavelength considering impedance matching and the like. The shortening rate is for example a few percentages or less of the ¼ wavelength. In the following explanation, unless indicated otherwise, the amount of adjustment in such an actual antenna will be ignored.

In the present embodiment, the antenna conductor 7 is basically in contact with the antenna substrate 5, so can perform emission and/or reception of radio waves through the antenna substrate 5. Accordingly, the wavelength referred to concerning the length of the antenna 1 is not one in a free space, but one in the antenna substrate 5. For example, in general, a wavelength $\lambda_g$ in the antenna substrate 5 is represented by the following equation.

$$\lambda_g=1/\sqrt{\varepsilon_r}\times\lambda_0=c/(\sqrt{\varepsilon_r}\times f)$$

where, $\varepsilon_r$ is a relative dielectric constant of the antenna substrate 5 (dielectric), $\lambda_0$ is the wavelength in a free space, "c" is a speed of light in a free space (in vacuum), and "f" is a frequency.

The main conductors 13 are for example configured by layered conductors parallel to the direction (x-direction) in which the pair of main conductors 13 have lengths toward the reverse sides to each other. The planar shapes thereof are for example shapes having the x-direction as the long direction. More specifically, for example, they are rectangular shapes having the x-direction as the long direction. However, in the end parts connected to the connection parts 19, corner portions which become outer peripheral sides of bending are chamfered. Naturally, such chamfering need not be carried out either. The lengths of the long sides are basically set in accordance with the wavelength aimed at. The lengths of the short sides and the thicknesses of the main conductors 13 may be suitably set. At this time, the influence of their dimensions exerted upon the gain may be considered as well.

Note that, the main conductors 13 and the connection lines 19 have widths, therefore the boundary of the two is not always clear. When it is necessary to design the length L1 of the main conductor 13 or necessary to specify the length L1 in an actual product, for example, the end part on the connection line 19 side of the length L1 may be made an edge part on the connection line 19 side of a conductor configuring the main conductor 13 and connection line 19 or may be made a center line (not shown) of the connection line 19. At this time, chamfering may be ignored. Note that, FIG. 2C shows the length L1 considering the center line of the connection line 19 as the end part on the connection line 19 side of the main conductor 13.

The first main conductor 13A is for example buried in the antenna substrate 5. Specifically, for example, the first main conductor 13A is provided in the same plane as that for the line conductor 9. The second main conductor 13B is for example superposed on the lower surface (surface) of the antenna substrate 5. Consequently, the antenna substrate 5 is provided in the same plane as that for the plate-shaped conductor 11. From another viewpoint, the first main conductor 13A and the second main conductor 13B are different from each other in the positions in the direction perpendicular to their planes (z-direction, thickness direction of the antenna substrate 5).

In a typical dipole antenna, the two conductors are positioned on the same straight line, therefore the two conductors are separated from each other so as not to cause short-circuiting. In the present embodiment, the pair of main conductors 13 are different from each other in the positions in the z-direction. Therefore, in the x-direction (when viewed in the z-direction), they may be separated from each other, may be adjacent to each other without a gap, or may overlap each other. In the example shown, although according to the definition of a boundary of the main conductor 13 and the connection line 19, as shown in FIG. 2C which shows the length L1, the pair of main conductors 13 are adjacent to each other in the x-direction without a gap when considering the boundary with the use of a not shown center line of the connection line 19.

The first main conductor 13A is connected with the line conductor 9, while the second main conductor 13B is connected with the plate-shaped conductor 11. Accordingly, the main conductor 13 (13A) for handling the signal is buried in the antenna substrate 5, while the main conductor 13 (13B) for handling the reference potential is positioned on the surface of the antenna substrate 5. From another viewpoint, the main conductor 13 (13A) for handling the signal is closer to the center of the thickness direction of the antenna substrate 5 than the main conductor 13 (13B) for handling the reference potential.

(Facing Conductors)

The first facing conductor 15A (at least a portion) faces the first main conductor 13A. The second facing conductor 15B (at least a portion) faces the second main conductor 13B. The facing direction is a direction (z-direction) intersecting with (for example perpendicular to) the direction (x-direction) in which the pair of main conductors 13 have lengths toward reverse sides to each other. Further, from another viewpoint, the facing direction is for example the direction intersecting with (for example perpendicular to) the plane formed by the layered main conductors 13.

Note that, as already explained, in the present embodiment, the shape of the antenna conductor 7 is rotation symmetrical by 180°. Therefore, in the following description, sometimes the facing conductors 15 will be explained in comparison with the main conductors 13 without differentiating the first facing conductor 15A and the second facing conductor 15B. For example, in the following description, the explanation of relative positions of the main conductors 13 and the facing conductors 15 basically corresponds to an explanation of the relative positions of the first main conductor 13A and the first facing conductor 15A and the explanation of the relative positions of the second main conductor 13B and the second facing conductor 15B.

The facing conductors 15 are for example configured by layered conductors which are parallel to the main conductors 13. The planar shapes thereof are for example shapes that have the direction (x-direction) in which the pair of main conductors 13 have lengths toward reverse sides to each other as the long direction. More specifically, for example, they are rectangular shapes having the x-direction as the long direction. From another viewpoint, the shapes of the facing conductors 15 are for example the same shapes as the shapes of the main conductors 13 or shapes formed by changing the aspect ratios of the shapes of the main conductors 13.

The lengths (x-direction), widths (y-direction), and thicknesses (z-direction) of the facing conductors 15 may be suitably set. For example, the lengths of the facing conductors 15 may be shorter, equal to (example shown), or longer relative to the lengths L1 of the main conductors 13. Further, the widths of the facing conductors 15 may be narrower, equal to (example shown), or broader relative to the widths of the main conductors 13. Further, the thicknesses of the facing conductors 15 may be thinner, equal to (example shown), or thicker relative to the thicknesses of the main conductors 13.

As understood also from the explanation of dimensions described above, when viewed in a facing direction with the main conductors 13 (z-direction), so far as at least portions of the facing conductors 15 are superposed on at least portions of the main conductors 13, the facing conductors 15 may fall into the main conductors 13, may coincide with the main conductors 13, or may include the main conductors 13. Further, when viewed in the z-direction, portions of the main conductors 13 may protrude from the facing conductors 15 and portions of the facing conductors 15 may protrude from the main conductors 13 (example shown). The directions of protrusion of the main conductors 13 or facing conductors 15 may be any directions which are parallel to the xy plane.

When viewed in the facing direction (z-direction), the facing conductors 15 may appear as if they are offset in position relative to the main conductors 13 (example shown) or may appear as if they match in position relative to the main conductors 13. For example, between the facing conductors 15 and the main conductors 13, when viewed in the z-direction, the centers of gravity in the figures may be offset from each other (example shown) or the centers of gravity in the figures may match with each other. Note that, the "center of gravity" in a figure is the point where the primary moment of the figure around that is 0. The direction of offset may be any direction. In the example shown, the direction of offset is to the outer sides of the pair of main conductors 13 (+x side of the first main conductor 13A in the first facing conductor 15A and −x side of the second main conductor 13B in the second facing conductor 15B).

In the example shown, the planar shapes and the positions on the xy plane of the facing conductors 15 are as follows. The facing conductors 15 are rectangular shapes having lengths (x-direction) and widths (y-direction) which are equal to the rectangular main conductors 13. That is, the facing conductors 15, including dimensions as well, have the same shapes as the main conductors 13. Further, the pair of facing conductors 15 are offset to the outer sides of the pair of main conductors 13 in the direction (x-direction) in which the pair of main conductors 13 have lengths toward reverse sides to each other. From another viewpoint, the pair of facing conductors 15 have portions which are positioned at the outer sides of the pair of main conductors 13 in the x-direction. Specifically, the first facing conductor 15A has a portion which is positioned closer to the positive side of the x-direction than the first main conductor 13A, and the second facing conductor 15B has a portion which is positioned closer to the negative side of the x-direction than the second main conductor 13B. Note that, the positions in the y-direction are the same between the facing conductors 15 and the main conductors 13.

The first facing conductor 15A is for example provided in the same plane as the second main conductor 13B. Further, it is positioned on the lower surface of the antenna substrate 5. On the other hand, the second facing conductor 15B is for example provided in the same plane as the first main conductor 13A. Further, it is buried in the antenna substrate 5. From another viewpoint, the first facing conductor 15A and the second facing conductor 15B are different from each other in the positions in the facing direction with the main conductors 13 (z-direction).

The first facing conductor 15A is for example separated from the second main conductor 13B in the x-direction so as not to cause short-circuiting with the second main conductor 13B positioned in the same plane. Specifically, the two are separated by about 30 μm to 120 μm in the x-direction. In the same way, the second facing conductor 15B is separated from the first main conductor 13A in the x-direction. Also, the second facing conductor 15B and the first main conductor 13A are separated by about 30 μm to 120 μm in the x-direction. On the other hand, in the present embodiment, the pair of main conductors 13 are adjacent without a gap (are not separated) or overlap in the x-direction (when viewed in the z-direction). Accordingly, the pair of facing conductors 15 are separated from each other in the x-direction (when viewed in the z-direction).

Note that, in the present embodiment, the pair of facing conductors 15 are different from each other in the positions in the z-direction, therefore there is no possibility of short-circuiting of the pair of facing conductors 15 with each other. Accordingly, from only this viewpoint, in the x-direction (when viewed in the z-direction), the pair of facing conductors 15 may be separated from each other, may be adjacent to each other without a gap, or may overlap each other. For example, in a mode where the pair of main conductors 13 are separated from each other in the x-direction or a mode where the facing conductors 15 and the main conductors 13 are not present in the same plane, the pair of facing conductors 15 may be made adjacent to each other without a gap as well.

The distances in the facing direction of the facing conductors 15 relative to the main conductors 13 may be suitably set. For example, the distances are for example smaller than the ¼ wavelength (from another viewpoint, the lengths L1 of the main conductors 13).

Note that, the inventors of the present application performed simulation computations for a plurality of cases in which the distances between the facing conductors 15 and the main conductors 13 were made different from each other. Specifically, the above distances were set less to than $\frac{1}{4}\lambda_g$ (specifically, about 60 μm), $\frac{1}{4}\lambda_g$, or $\frac{1}{2}\lambda_g$. In these computation results, the peak gain in the total gain became higher in the case of less than $\frac{1}{4}\lambda_g$ than the case of $\frac{1}{4}\lambda_g$ or $\frac{1}{2}\lambda_g$.

The "total gain" referred to here is a concept including the gains of vertical polarization, horizontal polarization, left hand circular polarization, and right hand circular polarization. The peak gain in the total gain is the maximum value of the total gain (not one obtained by adding up the peak gains relative to the different polarization for the plurality of polarizations). Note that, a peak gain in a gain is the largest value in the gain of each of the polarizations.

The distances in the x-direction between the facing conductors 15 and the main conductors 13 which are positioned in the same plane (from another viewpoint, the distances between the pair of facing conductors 15 in the x-direction) may be suitably set. For example, the minimum values of the distances may be made the distances of the limit where short-circuiting is not caused when considering manufacturing error or insulation breakdown. Further, the maximum value of the distances may be suitably set so far as at least portions of the facing conductors 15 face at least portions of the main conductors 13 (further, in the present embodiment, so far as the two can be connected by the connection conductors 17).

(Connection Conductors)

The first connection conductors 17A (17A-1 and 17A-2) are interposed between the first main conductor 13A and the first facing conductor 15A and connect them. The second connection conductors 17B (17B-1 and 17B-2) are interposed between the second main conductor 13B and the second facing conductor 15B and connect them.

As already alluded to, the first main conductor 13A and first facing conductor 15A and first connection conductor 17A and the second main conductor 13B and second facing conductor 15B and second connection conductor 17B are arranged and shaped substantially rotation symmetrically by 180° relative to each other. Therefore, here, the explanation will be given taking as an example the first connection conductors 17A among the first connection conductors 17A and second connection conductors 17B. However, in the following explanation of the first connection conductors 17A, the "first" and "A" may be replaced by the "second" and "B" and the explanation applied to the second connection conductors 17B.

The number of the first connection conductors 17A may be suitably set. In the example shown, two first connection conductors 17A are arranged in the direction (x-direction) in which the pair of main conductors 13 have lengths toward reverse sides relative to each other. From another viewpoint, the two first connection conductors 17A are arranged along a long direction of the first main conductor 13A shaped having a long direction.

The positions of the first connection conductors 17A may be suitably set. Note that, in the present embodiment, the first connection conductors 17A extend in the facing direction (z-direction) of the first main conductor 13A and the first facing conductor 15A. Therefore, in the following explanation, sometimes the connection positions of the first connection conductors 17A with respect to the first main conductor 13A or first facing conductor 15A will be simply alluded to as positions relative to these conductors (13A or 15A). The first connection conductors 17A may be positioned at any end parts of the first main conductor 13A and/or first facing conductor 15A in the x-direction or may be positioned at the intermediate position of the first main conductor 13A and/or first facing conductor 15A in the x-direction. Further, the positions in the y-direction may be suitably set. In the example shown, the first connection conductors 17A are positioned substantially at the centers of the first main conductor 13A and first facing conductor 15A in the y-direction.

In the example shown, the first connection conductor 17A-1 is positioned relative to the first main conductor 13A at an end part at an outer side of the pair of main conductors 13 and is positioned relative to the first facing conductor 15A in the intermediate position in the x-direction. Further, the first connection conductor 17A-2 is positioned relative to the first main conductor 13A in the intermediate position in the x-direction and is positioned relative to the first facing conductor 15A at an end part at an inner side of the pair of main conductors 13. In this way, in the present embodiment, the antenna conductor 7, unlike a folded dipole antenna, has at least one (two in the present embodiment) first connection conductor 17A separated from the two ends of at least one conductor between the first main conductor 13A and the first facing conductor 15A.

Note that, even when saying that a first connection conductor 17A is positioned at an end part of the first main conductor 13A or first facing conductor 15A in the x-direction, the first connection conductor 17A need not contact or overlap the edge in the x-direction (in the present embodiment, the short side of the rectangular shape) of the first main conductor 13A or first facing conductor 15A. This is because, for example, even in a design concept providing the first connection conductor 17A at the end part of the first main conductor 13A, the first connection conductor 17A may be separated from the edge of the first main conductor 13A in the x-direction in order to reliably secure a connection area of the first connection conductor 17A and the first main conductor 13A regardless of tolerances.

Conversely, for example, even in a case where a first connection conductor 17A is separated a little from the edge of the first main conductor 13A or first facing conductor 15A in the x-direction, this does not mean the first connection conductor 17A is positioned in the intermediate position (separated from the end part) of the first main conductor 13A or first facing conductor 15A in the x-direction. Accordingly, for example, in a case where a first connection conductor 17A is positioned closer to the center side of the first main conductor 13A in the x-direction relative to this conductor 13A compared with the connection positions of mutually facing conductors in a general folded dipole antenna, it may be judged that the first connection conductor 17A is separated from the end part of the first main conductor 13A.

Note that, in the example shown, even when saying that a first connection conductor 17A is positioned at an end part of the first main conductor 13A, the first connection conductor 17A-1 is separated from the edge (short side) of the first main conductor 13A in the x-direction by a distance of about the length of the first connection conductor 17A-1 (diameter) in the x-direction. On the other hand, the second connection conductor 17A-2 which is separated from the two ends of the first main conductor 13A is separated from the edges on the two sides of the first main conductor 13A in the x-direction by at least two times the length of the x-direction (diameter) of the connection conductor 17A-2.

The shapes of the connection conductors 17 may be suitably set. For example, the connection conductors 17 may be columnar as illustrated or, unlike FIG. 2A to 2C, may be shaped as layered patterns extending in the axial direction. Further, the connection conductors 17 may be solid (no cavities in the internal portions) as illustrated or, unlike FIG. 2A to 2C, may be hollow (cavities in the internal portions). The shapes of the cross-sections (xy cross-sections) parallel to the xy plane of the connection conductors 17 may be the same over the entire lengths in the z-direction as illustrated. Further, unlike FIG. 2A to 2C, they may be different according to the positions in the z-direction. Further, the shapes of the xy cross-sections may be for example circular as illustrated or, unlike FIG. 2A to 2C, may be oval or polygonal. The areas of the xy cross-sections may be suitably set.

(Connection Lines)

A first connection line 19A is for example positioned in the same plane as that for the first main conductor 13A and line conductor 9 and connects the same. A second connection line 19B is for example positioned in the same plane as that for the second main conductor 13B and plate-shaped conductor 11 and connects the same. The connection lines 19 are for example configured by layered patterns linearly extending with constant widths and extend to a direction (y-direction) perpendicular with respect to the direction (x-direction) in which the pair of main conductors 13 have lengths toward reverse sides to each other. The pair of connection lines 19 for example face each other in the facing direction (z-direction) of the pair of main conductors 13 and the pair of facing conductors 15. Further, they have for example the same shapes as each other.

The lengths of the connection lines 19 (distance of the antenna conductor 7 from the plate-shaped conductor 11) may be suitably set. For example, when the wavelength (in the antenna substrate 5) at the frequency at which the antenna 1 is utilized is $\lambda_g$, the lengths of the connection lines 19 may be made $\frac{1}{4}\lambda_g$. In this case, for example, the connection lines 19 can also be made to function like an antenna. As a result, the gain is improved. Further, for example, at the frequency at which the antenna 1 is utilized, a voltage standing wave ratio (VSWR) can be reduced. The widths of the connection lines 19 may be suitably set. In the example shown, the widths of the connection lines 19 are made equal to the width of the line conductor 9. However, they may be different from the width of the line conductor 9 as well.

(Distance from Antenna Conductor to End Face of Substrate)

Returning to FIG. 1, a distance Dt1 from the antenna conductor 7 (from the main conductors 13) to the end face 5*a* of the antenna substrate 5 on the negative side of the y-direction (the side where the antenna conductor 7 is positioned relative to the line conductor 9 and plate-shaped conductor 11) may be suitably set. For example, the distance Dt1 may be set to the lengths L1 of the main conductors 13 ($\lambda_g/4$ from another viewpoint) or more. Naturally, the distance Dt1 may be less than the lengths L1 as well.

Further, as indicated by the imaginary lines (two-dotted chain lines) in FIG. 1, the antenna substrate 5 may be made relatively longer toward the negative side of the y-direction. For example, when the wavelength (in the antenna substrate 5) at the frequency at which the antenna 1 is utilized is $\lambda_g$, the distance Dt1 may be made longer than $\lambda_g$. From another viewpoint, the distance Dt1 may be made 2 times the length of the entireties of the pair of main conductors 13 (2×(L1+L1)) in the x-direction.

(Multilayer Substrate Including Antenna)

As shown in FIG. 2B and FIG. 2C, the configuration of the antenna 1 explained above may be for example realized by the same structure as that of the multilayer substrate. Specifically, for example the antenna substrate 5 is configured by stacking a plurality of dielectric layers 21 (21A and 21B, one example of dielectric) The main conductors 13, facing conductors 15, line conductor 9, plate-shaped conductor 11, and connection lines 19 are for example configured by a first conductor layer 23A which is positioned at the lower surface of the dielectric layer 21 in the lowermost layer (first dielectric layer 21A) or a second conductor layer 23B which is positioned between mutually superposed dielectric layers 21 (21A and 21B) The connection conductors 17 are for example configured by via conductors passing through the first dielectric layer 21A.

In the example shown, the second dielectric layer 21B is thicker compared with the first dielectric layer 21A. However, the second dielectric layer 21B may be configured by stacking a plurality of dielectric layers having equal thicknesses to the first dielectric layer 21A as well. Also, the first dielectric layer 21A may be configured by stacking a plurality of dielectric layers. Note that, the thickness of the second dielectric layer 21B may be made the thickness of the first dielectric layer 21A or less.

The plurality of dielectric layers 21 (21A and 21B) may be configured by materials the same as each other or be configured by materials different from each other. When they are configured by the same materials as each other, a boundary of the mutually superposed dielectric layers 21 may be unable to be differentiated due to integral formation. The materials for the dielectric layers 21 are for example a ceramic and/or resin as already alluded to. One dielectric layer 21 may be configured by a single material or may be configured by a plurality of materials. When it is configured by a plurality of materials, for example, one dielectric layer 21 may be one formed by superposing a resin layer and an inorganic insulation layer on each other. Further, the plurality of dielectric layers 21 may have the same thicknesses as each other or may have different thicknesses from each other.

The plurality of conductor layers 23 (23A and 23B) may be configured by the same materials as each other or may be configured by different materials from each other. Further, the plurality of conductor layers 23 may have the same thicknesses as each other or may have different thicknesses from each other. One layer of the conductor layers 23 may be configured by a single metal material or may be configured by stacking metal layers which are made of different materials from each other. One layer of the conductor layers 23 is for example made of the same material having the same thickness irrespective of the position. However, one layer of the conductor layers 23 may be formed by different materials and/or different thicknesses according to the positions.

The first dielectric layer 21A has substantially a constant thickness over substantially the entirety in the surface direction thereof. Accordingly, the first conductor layer 23A and the second conductor layer 23B which face each other sandwiching the first dielectric layer 21A therebetween become substantially parallel to each other. Consequently, the pair of main conductors 13 and the pair of facing conductors 15 become substantially parallel to each other.

The via conductors (connection conductors 17) may be configured by a single metal material or may be configured by two or more types of materials. For example, different materials may be used between the outer circumferential surfaces and the internal portions. The via conductors may be configured by the same material as that for the conductor layer 23 or may be configured by a different material. Further, for example, when the first dielectric layer 21A is configured by a plurality of dielectric layers, a plurality of via conductors passing through those plurality of dielectric layers may be linked to configure the connection conductors 17 as well. In this case, the linked plurality of via conductors may be the same as each other in their shapes (dimensions) and/or materials or different from each other.

As the via conductors of the multilayer substrate, there can be mentioned various ones such as solid ones, hollow ones (including ones filled with an insulator in the internal portion), taper-shaped ones, inverse taper-shaped ones, ones having constant cross-sectional areas in the penetration direction, ones passing through only one layer of the dielectric layers, and ones passing through a plurality of dielectric layers. The connection conductors 17 may be configured by any of them.

Note that, although not particularly shown, the antenna 1 may have a not shown insulation film covering the first conductor layer 23A as well. The insulation film is for example thinner than the first dielectric layer 21A. Further, the insulation film is for example configured by solder resist.

(Method for Manufacturing Antenna 1)

A method for manufacturing the antenna 1 may be made the same as the method for manufacturing the multilayer substrate excluding specific shapes etc. Further, there are also various manufacturing methods for multilayer substrate. Any of these may be utilized.

For example, the antenna 1 may be fabricated by the so-called "build-up method". In the build-up method, a process of forming one dielectric layer 21 and forming via conductors (connection conductors 17) and/or conductor layer 23 with respect to this one dielectric layer 21 according to a need is repeated to successively stack and fasten a plurality of dielectric layers 21.

Further, for example the antenna 1 may be fabricated by a one-step stacking method of stacking ceramic green sheets forming the dielectric layers 21 and having conductive paste for forming via conductors and conductor layers 23 arranged thereon and firing this.

In the various methods described above, the methods of forming the dielectric layers 21, forming the holes for arranging the via conductors (connection conductors 17), and forming the via conductors and conductor layers 23 may be various known methods.

For example, each dielectric layer 21 may be formed by placing an uncured (liquid-state or film-state) thermosetting resin on a base material or a previously formed dielectric layer 21 and curing the same or may be formed by firing a ceramic green sheet.

Further, for example, a hole in which a via conductor (connection conductor 17) is arranged may be formed by wet etching and/or dry etching through a mask formed by photolithography or the like, may be formed by a laser beam narrowed in diameter, may be formed by punching, or may be formed by a drill. When the dielectric layer 23 is a photosensitive resin, it may be formed by photolithography as well.

Further, for example, the conductor layer 23 may be formed by an electroless plating method and/or electroplating method or may be formed by printing a conductive paste. Further, the conductor layer 23 may be formed on the entire surface of the dielectric layer 21, then patterned by etching through a mask or may be formed on the dielectric layer 21 through a mask and patterned by removing the portions on the mask together with the mask.

Further, for example, the via conductors (connection conductors 17) may be formed by an electroless plating method and/or electroplating method or may be formed by printing a conductive paste. Note that, a solid via conductor is formed by making the plating sufficiently grow in a hole or filling the conductive paste in the hole. Otherwise, by suitably stopping the growth of the plating or printing the conductive paste only on the inner surface of the hole, a hollow via conductor is formed.

As described above, the antenna 1 according to the present embodiment is provided with the pair of main conductors 13 having lengths from the positions where they are adjacent to each other toward the reverse sides relative to each other in the x-direction, the first facing conductor 15A facing the first main conductor 13A in the y-direction intersecting with the x-direction, and the second facing conductor 15B facing the second main conductor 13B in the y-direction.

Accordingly, for example, the gain is improved compared with the case where the antenna has only the pair of main conductors 13. Specifically, for example, the peak gain in the total gain and the peak gain in left hand circular polarization are improved. This was confirmed by simulation computations carried out by the inventors of the present application. Note that, in the relative positional relationships of the pair of main conductors 13 and the correspondence relationships between the pair of main conductors 13 and the potentials (signal and reference potential) and the like in the present embodiment, the peak gain in left hand circular polarization is larger than the peak gain in right hand circular polarization. As the reason for improvement of the peak gain by providing the facing conductors 15, for example there can be mentioned the fact that the mass of the antenna conductor 7 becomes large as a whole and/or the projection area of the antenna conductor 7 when viewed in the y-direction becomes large compared with the case where the antenna 1 has only the pair of main conductors 13.

Further, in the present embodiment, the pair of facing conductors 15 have portions positioned at the outer sides of the pair of main conductors 13 in the x-direction. That is, the first facing conductor 15A has a portion positioned closer to the positive side of the x-direction than the first main conductor 13A, and the second facing conductor 15B has a portion closer to the negative side of the x-direction than the second main conductor 13B.

Accordingly, for example, compared with a mode where the pair of facing conductors 15 do not have portions positioned on the outer sides of the pair of main conductors 13 (see FIG. 4, this mode is also included in the art according to the present disclosure), the peak gain in left hand circular polarization is improved. This was confirmed by simulation computations carried out by the inventors of the present application. Further, in the simulation computations carried out by the inventors of the present application, when the positions of the pair of facing conductors 15 were offset to the outer sides relative to the pair of main conductors 13 without changing the lengths of the pair of facing conductors 15, the peak gain in the total gain and the peak gain in left hand circular polarization were improved. From this viewpoint as well, a configuration where the pair of facing conductors 15 are offset to the outer sides relative to the pair of main conductors 13 is advantageous. Further, for example, in a folded dipole antenna, the positions of the end parts at the outer sides must coincide with each other between the facing conductors. However, in the present embodiment, such a restriction can be eased. As a result, for example, the second main conductor 13B and the first facing conductor 15A which are positioned on the same plane are separated in the x-direction so as not to cause short-circuiting, while the length of the first facing conductor 15A can be made longer regardless of the position of the end part 13*e* of the first main conductor 13A.

Further, in the present embodiment, the antenna 1 is further provided with at least one first connection conductor 17A connecting the first main conductor 13A and the first facing conductor 15A and at least one second connection conductor 17B connecting the second main conductor 13B and the second facing conductor 15B.

Accordingly, for example, compared with a mode in which the connection conductor 17 is not provided (see FIG. 6, this mode is also included in the art according to the present disclosure), the mass of the antenna conductor 7 and/or the projection area of the antenna conductor 7 when viewed in the y-direction becomes larger. As a result, for example the peak gain in left hand circular polarization is improved. This was confirmed by simulation computations carried out by the inventors of the present application.

Further, in the present embodiment, the pair of main conductors 13 and the pair of facing conductors 15 have shapes with the x-direction as the long direction. The at least one first connection conductor 17A includes one separated from the two ends of at least one conductor between the first main conductor 13A and the first facing conductor 15A in the x-direction. In the same way, the at least one second connection conductor 17B includes one separated from the two ends of at least one conductor between the second main conductor 13B and the second facing conductor 15B in the x-direction.

That is, the antenna 1 differs from a folded dipole antenna in the configuration and principle thereof. The connection conductors 17 need not be positioned at the end parts of the main conductors 13 and facing conductors 15. As a result, for example, the pair of facing conductors 15 having equal lengths to those of the pair of main conductors 13 can be offset to the outer sides in the x-direction relative to the pair of main conductors 13 as described above, while the two can be connected as well. That is, the degree of freedom in design is high.

Further, in the present embodiment, the pair of main conductors 13 and pair of facing conductors 15 are shaped with the x-direction as the long direction. The plurality of first connection conductors 17A are different from each other in positions in the x-direction. The plurality of second conductors 17B are different from each other in positions in the x-direction.

That is, the antenna 1 differs from a folded dipole antenna in the configuration and principle thereof. Any number of first connection conductors 17A and any number of second connection conductors 17B may be provided. By the plurality of first connection conductors 17A being provided, for example, connection between the first main conductor 13A and the first facing conductor 15A is reliably achieved.

Further, in the present embodiment, the pair of main conductors 13 are different from each other in positions in the z-direction (facing direction of the main conductor 13 and the facing conductor 15).

Accordingly, for example, the possibility of mutual short-circuiting of the pair of main conductors 13 is reduced, while the pair of main conductors 13 can be made closer in the x-direction (direction in which the pair of main conductors 13 have lengths toward the reverse sides to each other). As a result, for example, in the pair of main conductors 13 as a whole, lengths of a half wavelength without a gap are realized.

Further, in the present embodiment, the first main conductor 13A and the second facing conductor 15B are the same as each other in positions in the z-direction. The second main conductor 13B and the first facing conductor 15A are the same as each other in positions in the z-direction.

Accordingly, as described above, the positions of the pair of main conductors 13 in the z-direction are offset from each other, while the main conductor 13 and the facing conductor 15 which are not connected with each other are positioned in the same plane, therefore reduced thickness of the entire antenna conductor 7 can be achieved.

Further, in the present embodiment, the pair of main conductors 13 and pair of facing conductors 15 are layered conductors which are perpendicular to the z-direction.

Accordingly, for example, the antenna 1 can be realized by formation of a conductor pattern on a circuit board or the like. As a result, for example, reduction of size and/or modularization is facilitated.

Further, in the present embodiment, the antenna 1 is further provided with a dielectric (antenna substrate 5) at the inside of which or surface of which the pair of main conductors 13 and the pair of facing conductors are positioned.

Accordingly, the wavelength on the periphery of the antenna conductor 7 becomes shorter, therefore the antenna 1 can be reduced in size. Further, it is also possible to configure the antenna 1 by using a multilayer substrate.

Further, in the present embodiment, the first main conductor 13A is positioned in the internal portion of the dielectric (antenna substrate 5), the second main conductor 13B is positioned on the surface (lower surface) of the antenna substrate 5, the first facing conductor 15A is positioned on the lower surface of the antenna substrate 5, and the second facing conductor 15B is positioned in the internal portion of the antenna substrate 5.

Accordingly, for example, as explained above, a configuration is realized where the positions of the pair of main conductors 13 in the z-direction are offset from each other, while the main conductor 13 and the facing conductor 15 which are not connected with each other are positioned on the same plane. Further, for example, the second main conductor 13B etc. are not covered by the dielectric. Therefore, compared with the mode of covering them (see FIG. 9, this mode is also included in the art according to the present disclosure), the peak gain in the total gain and the peak gain in left hand circular polarization are improved. This was confirmed, although only for a configuration having only the pair of main conductors 13, by simulation computations carried out by the inventors of the present application.

Further, in the present embodiment, the antenna 1 has the plate-shaped conductor 11 and line conductor 9. The plate-shaped conductor 11 is positioned in the internal portion or on the surface (surface in the present embodiment) of the dielectric (antenna substrate 5). The line conductor 9 is positioned in the internal portion or on the surface (internal portion in the present embodiment) of the antenna substrate 5, faces the plate-shaped conductor 11 through the antenna substrate 5, and extends along the plate-shaped conductor 11.

Accordingly, for example, by suitably adjusting the distance between the antenna conductor 7 and the plate-shaped conductor 11, the gain can be improved or the VSWR can be lowered. Such adjustment can be carried out as a design change of the configuration of the internal portion of the antenna 1.

Further, in the present embodiment, the main conductor 13 which is closer to the center of the antenna substrate 5 (first main conductor 13A) in the y-direction between the pair of main conductors 13 and the line conductor 9 are connected, while one (second main conductor 13B) which is further away from the center of the antenna substrate 5 in the y-direction between the pair of main conductors 13 and the plate-shaped conductor 11 are connected.

Accordingly, for example, compared with the mode reverse to the present embodiment in which the main conductor 13 closer to the center of the thickness of the antenna substrate 5 and the plate-shaped conductor 11 are connected, and the main conductor 13 further away from the center of the thickness of the antenna substrate 5 and the line conductor 9 are connected (see FIG. 10, this mode is also included in the art according to the present disclosure), the peak gain in the total gain and the peak gain in left hand circular polarization are improved. This was confirmed by simulation computations carried out by the inventors of the present application.

Further, in the present embodiment, the pair of main conductors 13 are positioned closer to the negative side of the y-direction intersecting with (perpendicular to) the x-direction (direction in which the pair of main conductors 13 have lengths) and the z-direction (facing direction of the pair of main conductors 13 and the pair of facing conductors 15), than the plate-shaped conductor 11 and line conductor 9. The distance Dt1 from each the pair of main conductors 13 up to the end face 5*a* of the dielectric (antenna substrate 5) on the negative side in the y-direction is the same as or longer than the length L1 of the main conductor 13 in the x-direction.

Here, in the simulation computations carried out by the inventors, the gain on the negative side of the y-direction was improved more as the distance Dt1 was longer, consequently the peak gain in the total gain, the peak gain in left hand circular polarization, and the peak gain in right hand circular polarization became higher. Accordingly, for example, by making the distance Dt1 the length L1 or more, it is made easier to obtain the desired peak gain. A further higher peak gain may be obtained by making the distance Dt1 not less than $\lambda_g$.

Second Embodiment

Figure 3A:
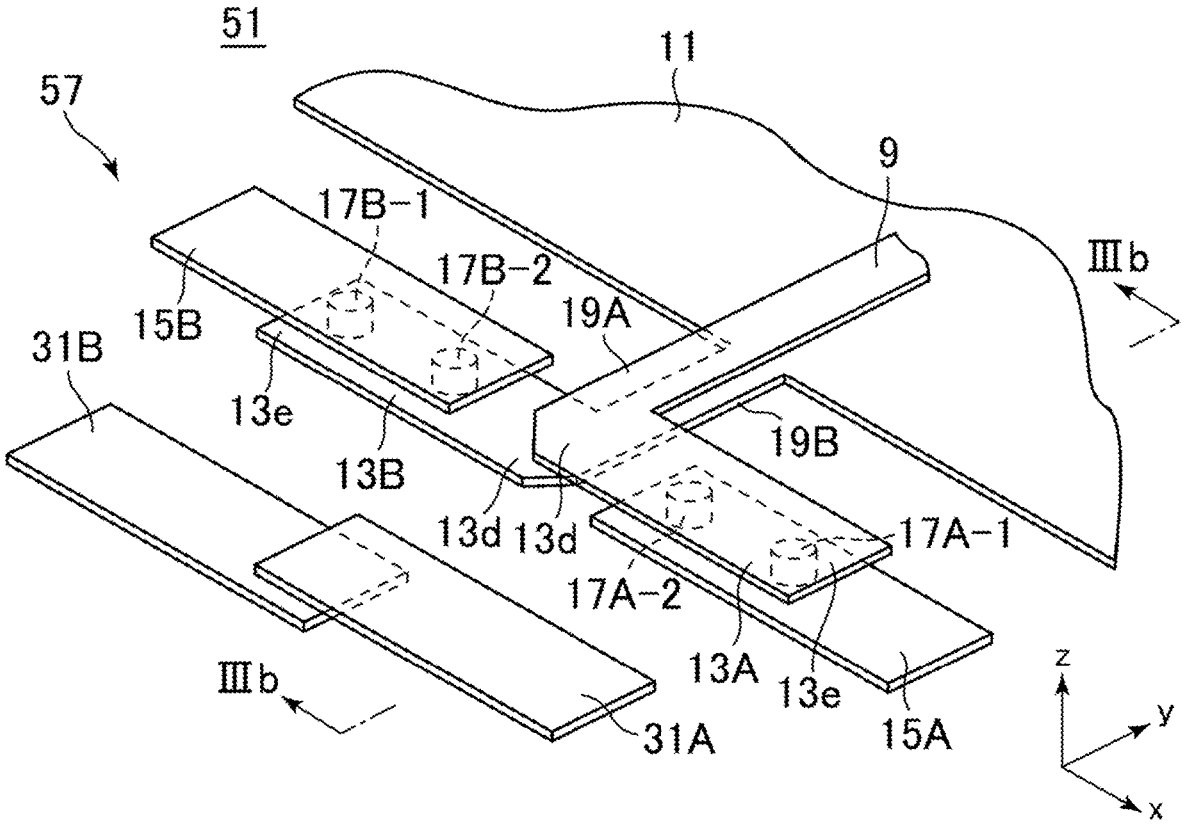
FIG. 3A is a perspective view showing the configuration of a principal part in an antenna according to a second embodiment.
Figure 3B:
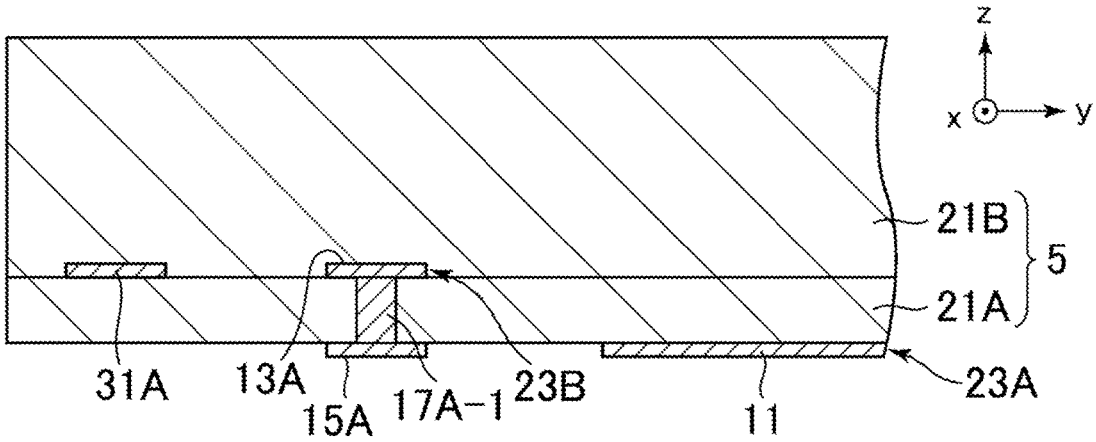
FIG. 3B is a cross-sectional view taken along the IIIb-IIIb line in FIG. 3A.

FIG. 3A is a perspective view the same as FIG. 2A of the first embodiment and shows the configuration of the principal parts of an antenna 51 according to a second embodiment. FIG. 3B is a cross-sectional view taken along the IIIb-IIIb line in FIG. 3A. In FIG. 3A, in the same way as FIG. 2A, illustration of the antenna substrate 5 is omitted.

The antenna 51 is different from the antenna 1 in the first embodiment only in the point that a pair of expansion conductors 31 (31A and 31B) are added at the antenna conductor 57.

The first expansion conductor 31A is positioned on the negative side of the y-direction (the side opposite to the plate-shaped conductor 11 and line conductor 9) relative to the first main conductor 13A and first facing conductor 15A. In the same way, the second expansion conductor 31B is positioned on the negative side of the y-direction relative to the second main conductor 13B and second facing conductor 15B. By providing such a pair of expansion conductors 31, the gain in the direction from the pair of main conductors 13 and pair of facing conductors 15 to the pair of expansion conductors 31 (negative side of the y-direction) can be improved.

Note that, an antenna conductor 57 in the antenna 51 is for example shaped rotation symmetrically by 180° about a not shown symmetrical axis parallel to the y-axis in the same way as the antenna conductor 7 in the first embodiment. Therefore, in the following description, sometimes the first expansion conductor 31A and the second expansion conductor 31B will not be differentiated, and the expansion conductors 31 will be explained in comparison with the main conductors 13 and/or facing conductors 15. For example, in the following description, the explanation of the relative positions of the main conductors 13 and the expansion conductors 31 corresponds to an explanation of the relative positions of the first main conductor 13A and the first expansion conductor 31A and an explanation of the relative positions of the second main conductor 13B and the second expansion conductor 31B.

The expansion conductors 31 are for example configured by layered conductors parallel to the main conductors 13. The planar shapes thereof are for example shapes with the direction (x-direction) in which the pair of main conductors 13 have lengths toward the reverse sides to each other as the long directions. More specifically, for example, they are rectangular shapes with the x-direction as the long directions. From another viewpoint, the shapes of the expansion conductors 31 are for example the same as the shapes of the main conductors 13 or shapes formed by changing the aspect ratios of the shapes of the main conductors 13.

The lengths (x-direction), widths (y-direction), and thicknesses (z-direction) of the expansion conductors 31 may be suitably set. For example, the lengths of the expansion conductors 31 may be shorter, equal to, or longer relative to the lengths L1 of the main conductors 13. Further, the widths of the expansion conductors 31 may be narrower, equal to (example shown), or broader relative to the widths of the main conductors 13. Further, the thicknesses of the expansion conductors 31 may be thinner, equal to (example shown), or thicker relative to the thicknesses of the main conductors 13. Note that, in the explanation described above, the term the "main conductors 13" may be replaced by the term "facing conductors 15" as well.

In the direction (x-direction) in which the pair of main conductors 13 have lengths toward reverse sides to each other (when viewed in the y-direction), the expansion conductors 31, for example, at least in part, are positioned in ranges where the main conductors 13 are present (ranges from the end parts 13*d* to the end parts 13*e*, ranges of the lengths L1 (see FIG. 2C)). Note that, the expansion conductors 31, in the x-direction, may fall inside the main conductors 13, may coincide with the main conductors 13, or may include the main conductors 13. Further, portions of the main conductors 13 may expand toward one side of the x-direction relative to the expansion conductors 31 and portions of the expansion conductors 31 may expand toward the other side of the x-direction relative to the main conductors 13. Further, the centers in the x-direction of the expansion conductors 31 and the main conductors 13, in the x-direction (when viewed in the y-direction), may be offset from each other or may coincide with each other. When they are offset in the x-direction, the offset may be closer to any side of the x-direction. Note that, in the explanation described above, the term the "main conductors 13" may be replaced by the term "facing conductors 15" as well.

The expansion conductors 31 are, for example, positioned at least in part in ranges from the main conductors 13 to the facing conductors 15 in the facing direction (z-direction) of the main conductors 13 and the facing conductors 15 (when viewed in the y-direction). However, the expansion conductors 31 may be separated from the ranges described before toward the z-direction by certain degrees of distances (for example, not more than the distances between the main conductors 13 and the facing conductors 15). The expansion conductors 31 may coincide with the main conductors 13 or facing conductors 15 in the positions in the z-direction (example shown) or may be offset in the positions in the z-direction from both of the main conductors 13 and facing conductors 15.

The pair of expansion conductors 31 may be the same as each other or different from each other (example shown) in the positions in the z-direction. The pair of expansion conductors 31 may be separated from each other, may be adjacent to each other without a gap, or may overlap each other (example shown) in the x-direction.

If summarizing the shapes, positions, etc. of the expansion conductors 31 in the example shown, we get the following. The expansion conductors 31 are rectangular shaped with the long directions of the main conductors 13 as their long directions. The widths (y-direction) thereof are equal to the widths of the main conductors 13. The lengths of the expansion conductors 31, although depending on the definition of the "boundaries" between the main conductors 13 and the connection lines 19 (definition of the lengths L1 of the main conductors 13), when defining the lengths L1 as shown in FIG. 2C, are longer than the lengths L1 of the main conductors 13 by exactly the amount of overlap of the pair of expansion conductors 31 in the x-direction. The expansion conductors 31 are positioned on the negative side of the y-direction relative to the main conductors 13. The positions of the expansion conductors 31 in the x-direction and z-direction are the same as the positions of the main conductors 13 in the x-direction and z-direction.

As explained in the first embodiment, the pair of main conductors 13 are different from each other in the positions in the z-direction. On the other hand, in the example shown, the first expansion conductor 31A is the same as the first main conductor 13A in the position in the z-direction, and the second expansion conductor 31B is the same as the second main conductor 13B in the position in the z-direction. Accordingly, in the example shown, the first expansion conductor 31A and the second expansion conductor 31B are different from each other in the positions in the z-direction.

The expansion conductors 31, in the same way as the main conductors 13 or facing conductors 15, for example, are configured by the conductor layers 23 provided in the antenna substrate 5. Specifically, in the present embodiment, the first expansion conductor 31A is configured by the second conductor layer 23B together with the first main conductor 13A, and the second expansion conductor 31B is configured by the first conductor layer 23A together with the second main conductor 13B (see FIG. 2C).

As described above, in the present embodiment as well, in the same way as the first embodiment, the antenna 51 is provided with the pair of main conductors 13 and the pair of facing conductors 15 facing the pair of main conductors 13. Accordingly, the same effects as those by the first embodiment are obtained. For example, the gain can be improved compared with the case where the antenna has only the pair of main conductors 13. Specifically, for example, the peak gain in the total gain and the peak gain in left hand circular polarization can be improved.

Further, in the present embodiment, the antenna 1 has the pair of expansion conductors 31. The first expansion conductor 31A is positioned closer to the negative side of the y-direction than the first main conductor 13A and first facing conductor 15A. In the same way, the second expansion conductor 31B is positioned closer to the negative side of the y-direction than the second main conductor 13B and second facing conductor 15B.

Accordingly, for example, the gain on the negative side of the y-direction can be made larger and consequently the peak gain in the total gain and the like can be improved. This was confirmed by simulation computations carried out by the inventors of the present application. Here, in a mode where the expansion conductors 31 are provided without providing the facing conductors 15, compared with the mode in which neither the facing conductors 15 nor the expansion conductors 31 are provided, all of the peak gain in the total gain, the peak gain in left hand circular polarization, and the peak gain in right hand circular polarization fall. This was confirmed by simulation computations carried out by the inventors of the present application. Accordingly, the effects in the present embodiment are ones due to the result of organic connection of the expansion conductors 31 and the facing conductors 15. The present embodiment may be said to be an epoch-making one.

Further, in the present embodiment, the first expansion conductor 31A, when viewed in the y-direction, is at least in part positioned in the range from the end part 13*d* to the end part 13*e* of the first main conductor 13A and positioned in the range from the first main conductor 13A to the first facing conductor 15A in the z-direction. In the same way, the second expansion conductor 31B, when viewed in the y-direction, is at least in part positioned in the range from the end part 13*d* to the end part 13*e* of the second main conductor 13B and positioned in the range from the second main conductor 13B to the second facing conductor 15B in the z-direction.

Accordingly, the gain from the pair of main conductors 13 to the negative side of the y-direction can be reliably made larger.

Third Embodiment

Figure 4:
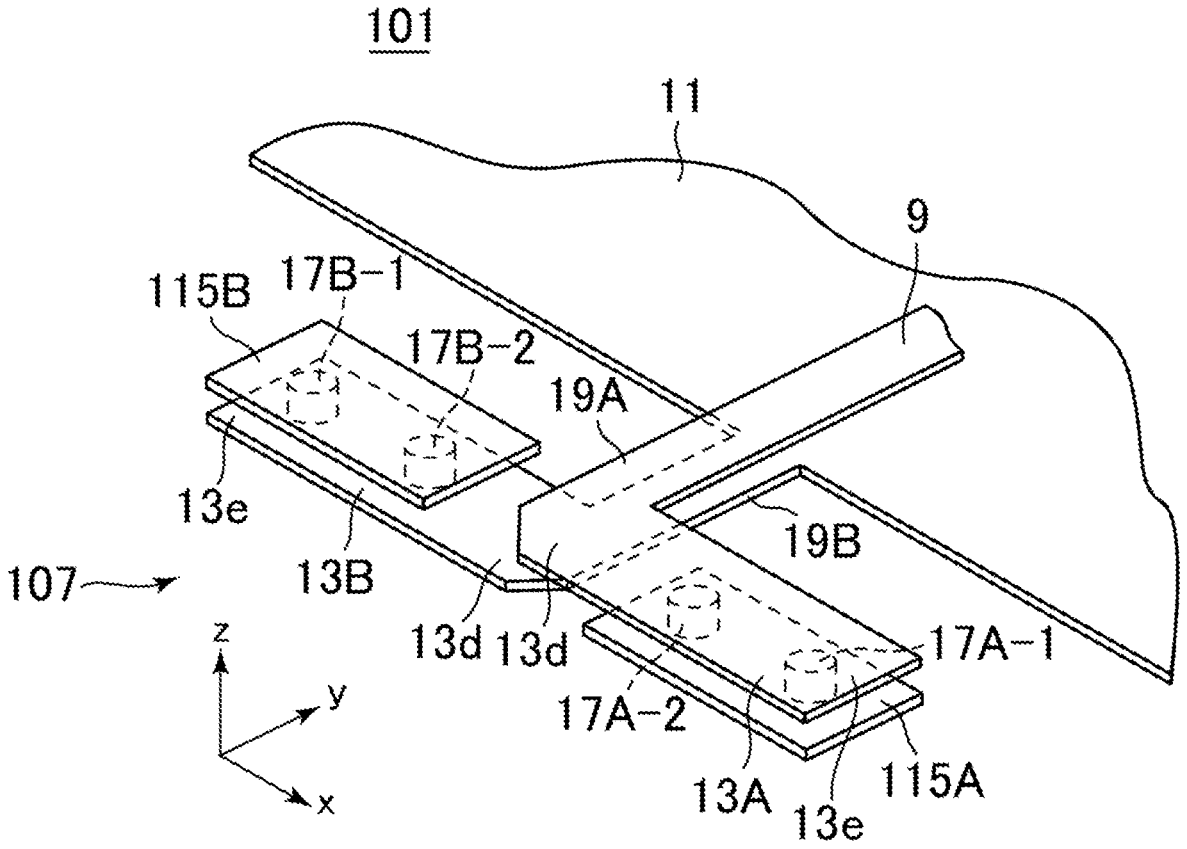
FIG. 4 is a perspective view showing the configuration of the principal part in an antenna according to a third embodiment.

FIG. 4 is a perspective view the same as FIG. 2A of the first embodiment and shows the configuration of the principal parts in an antenna 101 according to a third embodiment. In FIG. 4, in the same way as FIG. 2A, illustration of the antenna substrate 5 is omitted.

The antenna 101 differs from the antenna 1 in the first embodiment only in the point that, in the antenna conductor 107, the lengths (x-direction) of the pair of facing conductors 115 (115A and 115B) are made shorter than the lengths (x-direction) of the pair of facing conductors 15 in the first embodiment. Specifically, this is as follows.

The pair of facing conductors 115 are provided so that the positions of their edge parts at the outer sides in the x-direction coincide with the positions of the edge parts at the outer sides of the pair of main conductors 13 in the x-direction. That is, the edge part of the first facing conductor 115A on the positive side of the x-direction coincides in the position in the x-direction with the edge part (end part 13*e*) of the first main conductor 13A on the positive side of the x-direction, and the edge part of the second facing conductor 115B on the negative side of the x-direction coincides in the position in the x-direction with the edge part (end part 13*e*) of the second main conductor 13B on the negative side in the x-direction.

The edge parts of the pair of facing conductors 115 at the inner sides of the x-direction are separated from the main conductors 13 so as not to cause short-circuiting with the main conductors 13 positioned in the same plane in the same way as the first embodiment. Accordingly, as a result of making the positions at the edge parts at outer sides in the x-direction coincide with the pair of main conductors 13, the pair of facing conductors 115 become shorter in their lengths than the pair of main conductors 13.

As described above, in the present embodiment as well, in the same way as the first embodiment, the antenna 101 is provided with the pair of main conductors 13 and the pair of facing conductors 115 facing the pair of main conductors 13. Accordingly, the same effects as those in the first embodiment are obtained. For example, the gain can be improved compared with the case where the antenna only has the pair of main conductors 13. Specifically, for example, the peak gain in the total gain and the peak gain in left hand circular polarization can be improved.

Further, in the present embodiment, unlike the first embodiment, the pair of facing conductors 115 do not have portions positioned at the outer sides of the pair of main conductors 13 in the x-direction. Accordingly, for example, this is advantageous for reduction of size in the x-direction.

Note that, the present embodiment may be combined with the second embodiment as well. That is, the configuration having the pair of expansion conductors 31 may be provided with the pair of facing conductors 115 without having portions positioned at the outer sides of the pair of main conductors 13 in the x-direction.

Fourth Embodiment

Figure 5:
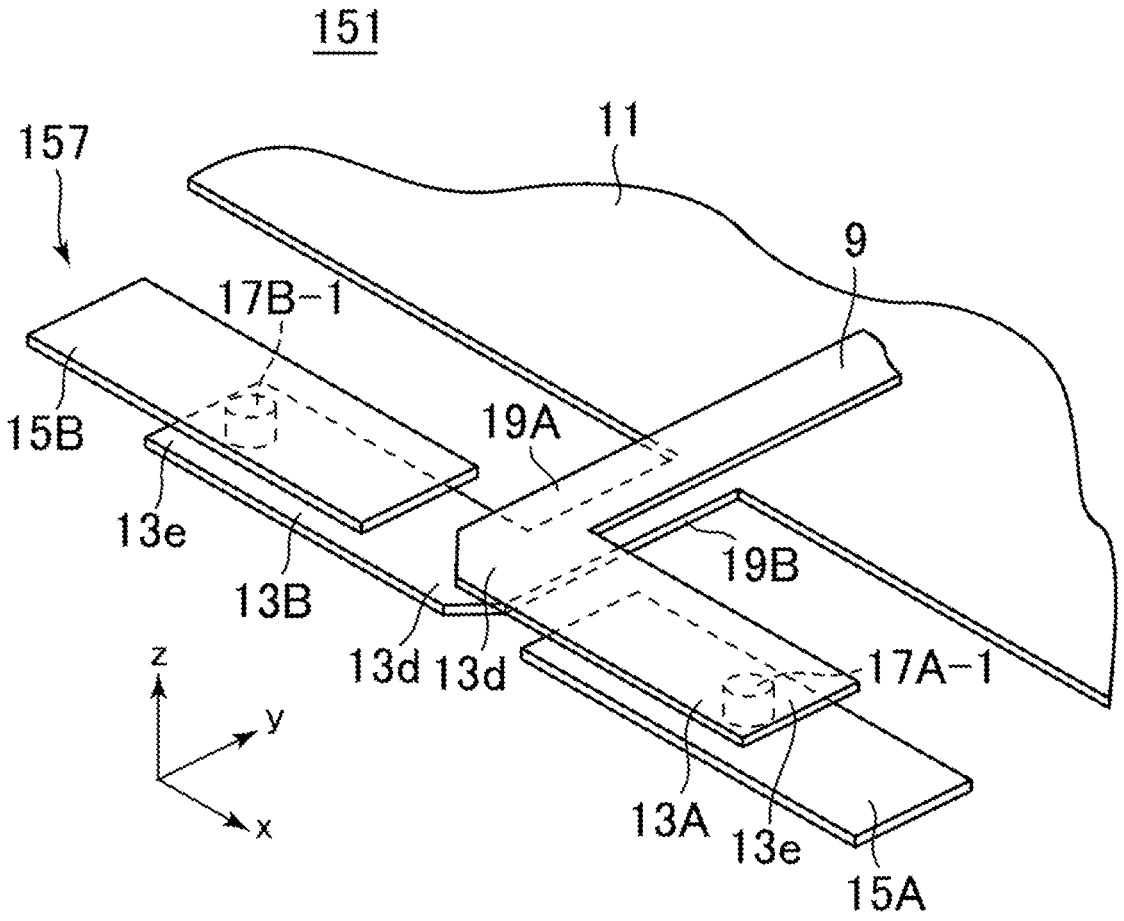
FIG. 5 is a perspective view showing the configuration of the principal part in an antenna according to a fourth embodiment.

FIG. 5 is a perspective view the same as FIG. 2A of the first embodiment and shows the configuration of the principal parts of an antenna 151 according to a fourth embodiment. In FIG. 5, in the same way as FIG. 2A, illustration of the antenna substrate 5 is omitted.

The antenna 151 differs from the antenna 1 in the first embodiment only in the point that, in the antenna conductor 157, only one first connection conductor 17A is provided, and only one second connection conductor 17B is provided.

Specifically, in the antenna conductor 157, only the first connection conductor 17A-1 is provided between the first connection conductors 17A-1 and 17A-2 in the first embodiment. Further, only the second connection conductor 17B-1 is provided between the second connection conductors 17B-1 and 17B-2 in the first embodiment.

Note that, unlike the illustration, only the first connection conductor 17A-2 and second connection conductor 17B-2 need be provided as well. Further, only one first connection conductor 17A and only one second connection conductor 17B need be provided at positions different from those of the connection conductors 17 in the first embodiment.

As described above, in the present embodiment as well, in the same way as the first embodiment, the antenna 151 is provided with the pair of main conductors 13 and the pair of facing conductors 15 facing the pair of main conductors 13. Accordingly, the same effects as those in the first embodiment are obtained. For example, the gain can be improved compared with the case where the antenna has only the pair of main conductors 13. Specifically, for example, the peak gain in the total gain and the peak gain in left hand circular polarization can be improved.

For example, in the present embodiment, there is only one first connection conductor 17A and only one second connection conductor 17B. Therefore, for example, the main conductors 13 or facing conductors 15 need not have areas large enough to be connected with a plurality of connection conductors 17. As a result, for example, this is advantageous for reduction of size of the antenna 151 in the x-direction.

Note that, the present embodiment may be combined with the second embodiment, third embodiment, or an embodiment combining the same.

Fifth Embodiment

Figure 6:
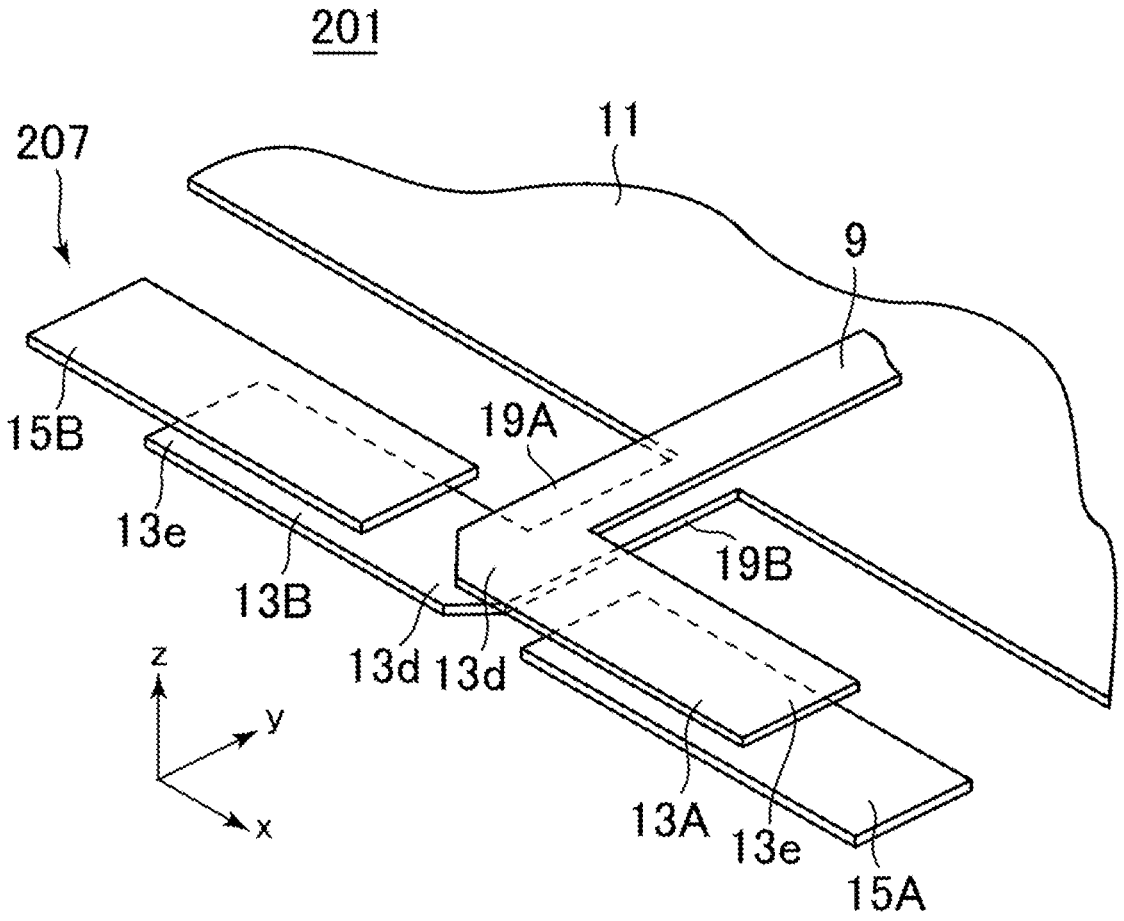
FIG. 6 is a perspective view showing the configuration of the principal part in an antenna according to a fifth embodiment.

FIG. 6 is a perspective view the same as FIG. 2A of the first embodiment and shows the configuration of the principal parts of an antenna 201 according to a fifth embodiment. In FIG. 6, in the same way as FIG. 2A, illustration of the antenna substrate 5 is omitted.

The antenna 201 differs from the antenna 1 in the first embodiment only in the point that no connection conductor 17 at all is provided in an antenna conductor 207.

In the present embodiment as well, in the same way as the first embodiment, the antenna 201 is provided with the pair of main conductors 13 and the pair of facing conductors 15 facing the pair of main conductors 13. Accordingly, the same effects as those in the first embodiment are obtained. For example, the gain can be improved compared with the case where the antenna has only the pair of main conductors 13. Specifically, for example, the peak gain in the total gain and the peak gain in left hand circular polarization can be improved.

Note that, the following was confirmed by the results of simulation: The peak gain in the total gain and the peak gain in left hand circular polarization are improved compared with the case where the antenna has only the pair of main conductors 13 by providing the facing conductors 15 even if no connection conductors 17 are provided. However, the degree of improvement is higher in the case where the connection conductors 17 are provided.

Further, in the present embodiment, since no connection conductors 17 are provided, for example, the configuration of the antenna 201 is simplified. As a result, for example, the manufacturing cost is reduced.

Note that, the present embodiment may be combined with the second embodiment, third embodiment, or an embodiment combining the same.

Sixth Embodiment

Figure 7:
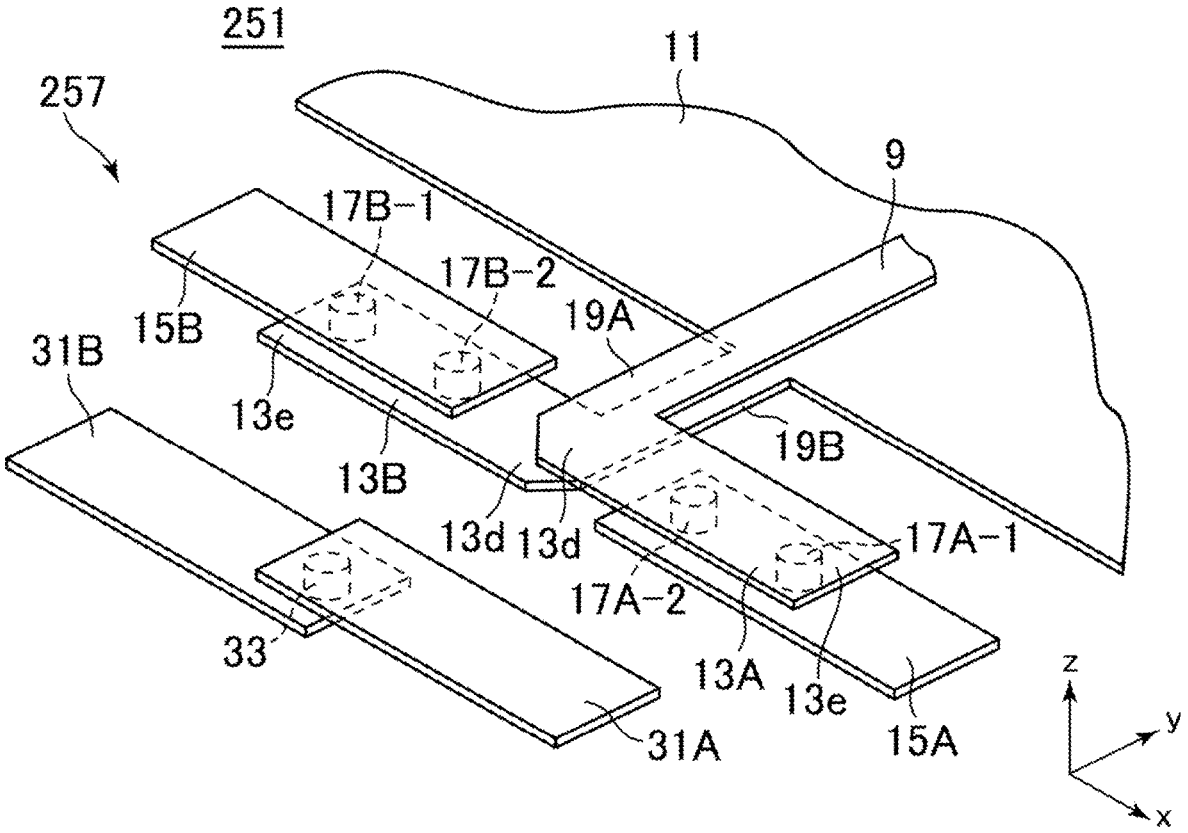
FIG. 7 is a perspective view showing the configuration of the principal part in an antenna according to a sixth embodiment.

FIG. 7 is a perspective view the same as FIG. 2A of the first embodiment and shows the configuration of the principal parts of an antenna 251 according to a sixth embodiment. In FIG. 7, in the same way as FIG. 2A, illustration of the antenna substrate 5 is omitted.

The antenna 251 differs from the antenna 51 in the second embodiment (FIG. 3) only in the point that a connection conductor 33 connecting the pair of expansion conductors 31 to each other is provided in an antenna conductor 257. The number, position, and shape of the connection conductor 33 may be suitably set. In the example shown, in the overlapping portion of the pair of expansion conductors 31, one connection conductor 33 having the same configuration as that of the connection conductor 17 is provided.

As described above, in the present embodiment as well, in the same way as the first embodiment, the antenna 251 is provided with the pair of main conductors 13 and the pair of facing conductors 15 facing the pair of main conductors 13. Accordingly, for example, the gain can be improved compared with the case where the antenna has only the pair of main conductors 13. Specifically, for example, the peak gain in left hand circular polarization and the peak gain in right hand circular polarization can be improved. This was confirmed by simulation computations carried out by the inventors of the present application.

Further, in the present embodiment, the pair of expansion conductors 31 are connected. Due to this, in the present embodiment, when compared with the second embodiment, the peak gain in the total gain and the peak gain in left hand circular polarization fall, but the peak gain in right hand circular polarization is improved. These facts were confirmed by simulation computations carried out by the inventors of the present application.

Note that, the present embodiment may be combined with an embodiment obtained by combining the second embodiment with one or two of the third to fifth embodiments (however, selecting either the fourth or fifth embodiment) as well.

Seventh Embodiment

Figure 8:
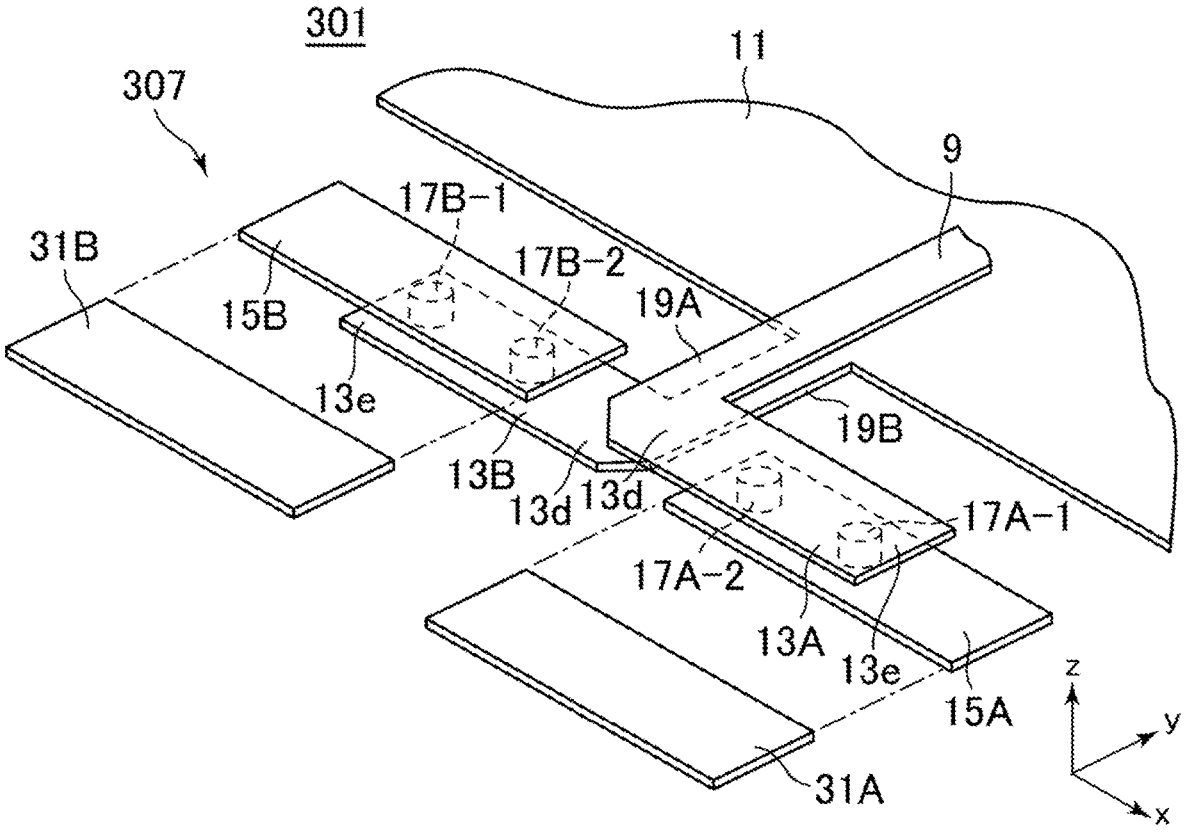
FIG. 8 is a perspective view showing the configuration of the principal part in an antenna according to a seventh embodiment.

FIG. 8 is a perspective view the same as FIG. 2A of the first embodiment and shows the configuration of the principal parts of an antenna 301 according to a seventh embodiment. In FIG. 8, in the same way as FIG. 2A, illustration of the antenna substrate 5 is omitted.

The antenna 301 differs from the antenna 51 in the second embodiment (FIG. 3) only in the positions of the expansion conductors 31. Specifically, in contrast to the second embodiment in which the expansion conductors 31 were positioned relative to the main conductors 13 on the negative side of the y-direction, in the present embodiment, the expansion conductors 31 are positioned relative to the facing conductors 15 on the negative side in the y-direction.

Specifically, the first expansion conductor 31A is the same as the first facing conductor 15A in the position in the z-direction and the position in the x-direction. The second expansion conductor 31B is the same as the second facing conductor 15B in the position in the z-direction and the position in the x-direction. Note that, unlike the illustration, between the expansion conductor 31 and the facing conductor 15, the positions in the x-direction may be offset or the lengths in the x-direction may be different.

As described above, in the present embodiment as well, in the same way as the first embodiment, the antenna 301 is provided with the pair of main conductors 13 and the pair of facing conductors 15 facing the pair of main conductors 13. Accordingly, for example, in the same way as the first embodiment, the gain can be improved compared with the case where the antenna has only the pair of main conductors 13. Specifically, for example, the peak gain in the total gain and the peak gain in left hand circular polarization can be improved.

Further, it was confirmed by simulation computations carried out by the inventors of the present application that, in the present embodiment, the positions of the pair of expansion conductors 31 are different from those in the second embodiment, but a gain of same degree as that in the second embodiment is obtained.

Note that, the present embodiment may be combined with one or more among the third to sixth embodiments (however, selecting either the fourth and fifth embodiment) as well.

Eighth Embodiment

Figure 9:
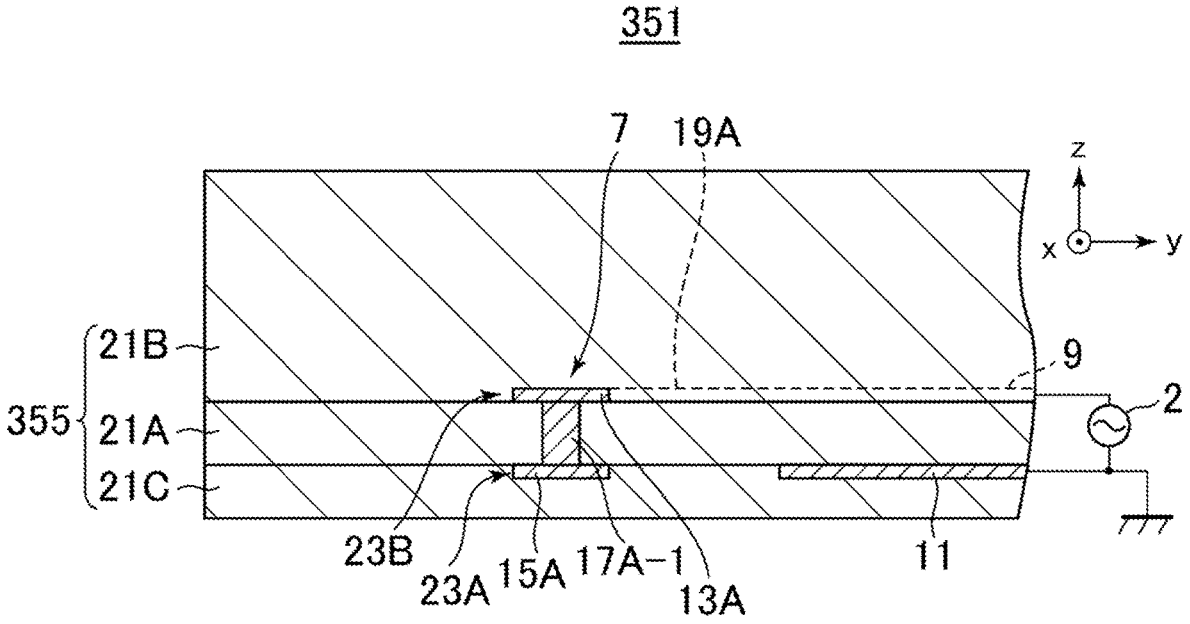
FIG. 9 is a perspective view showing the configuration of the principal part in an antenna according to an eighth embodiment.

FIG. 9 is a cross-sectional view the same as FIG. 2B of the first embodiment and shows the configuration of the principal parts of an antenna 351 according to an eighth embodiment. In FIG. 9, unlike FIG. 2B, the line conductor 9 and first connection line 19A positioned on the deeper side than the shown cross-section are indicated by broken lines.

The antenna 351 differs from the antenna 1 in the first embodiment only in the point that an antenna substrate 355 has a third dielectric layer 21C in addition to the first dielectric layer 21A and second dielectric layer 21B. From another viewpoint, in contrast to the first embodiment in which one portion of the antenna conductor 7 was buried in the dielectric (antenna substrate 5) and another portion was positioned on the surface of the antenna substrate 5, in the present embodiment, the antenna conductor 7 is buried in its entirety in the antenna substrate 355.

Specifically, the third dielectric layer 21C is superposed on the lower surface of the first dielectric layer 21A which was positioned in the lowermost layer in the first embodiment and covers the first conductor layer 21A. The first conductor layer 21A, as explained in the first embodiment, for example, configures the plate-shaped conductor 11, second connection line 19B (see FIG. 2A), second main conductor 13B (see FIG. 2A), and first facing conductor 15A.

As described above, in the present embodiment as well, in the same way as the first embodiment, the antenna 351 is provided with the pair of main conductors 13 and the pair of facing conductors 15 facing the pair of main conductors 13. Accordingly, for example, in the same way as the first embodiment, the gain can be improved compared with the case where the antenna has only the pair of main conductors 13. Specifically, for example, the peak gain of the total gain and the peak gain of left hand circular polarization can be improved.

Further, in the present embodiment, the antenna conductor 7 is buried in the antenna substrate 355, therefore the antenna conductor 7 need not always be arranged on the surface of the antenna substrate 355. As a result, for example, it is made easier to secure an area to be utilized for another purpose on the surface of the antenna substrate 355. For example, a land for mounting suitable electronic parts can be provided at the position overlapping the plate-shaped conductor 11.

Note that, the present embodiment may be combined with one or more among the second to seventh embodiments (however, selecting either the second and seventh embodiments and selecting either the fourth and fifth embodiments).

Ninth Embodiment

Figure 10:
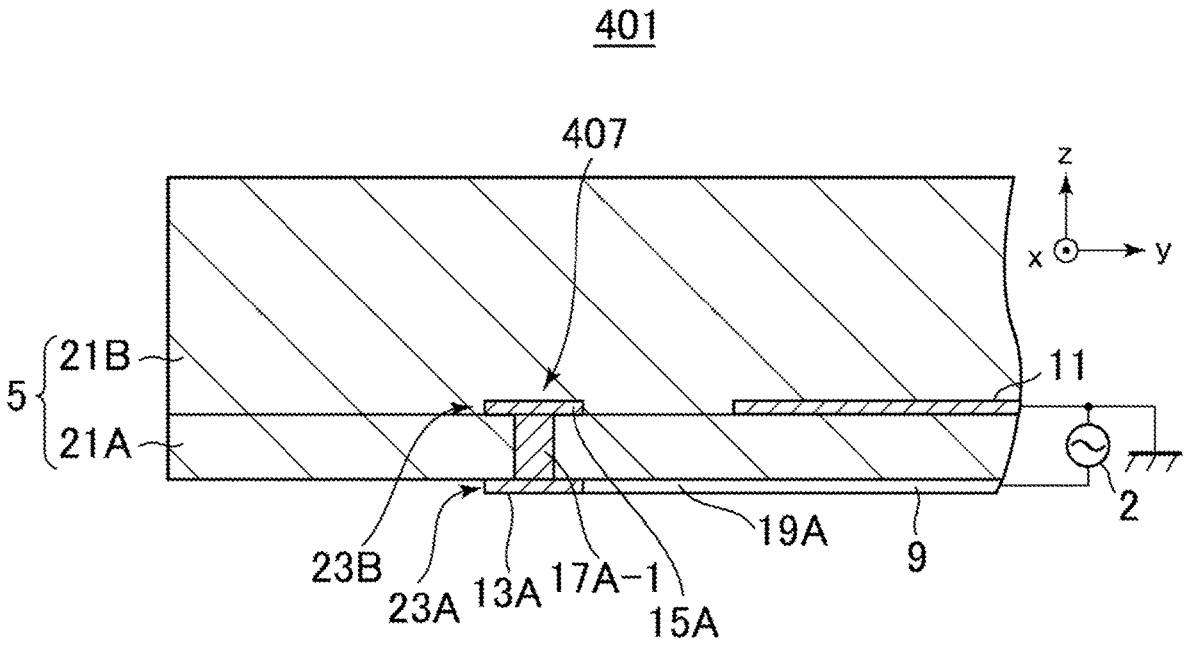
FIG. 10 is a perspective view showing the configuration of the principal part in an antenna according to a ninth embodiment.

FIG. 10 is a cross-sectional view the same as FIG. 2B of the first embodiment and shows the configuration of the principal parts of an antenna 401 according to a ninth embodiment. In FIG. 9, unlike FIG. 2B, the line conductor 9 and first connection line 19A positioned on the deeper sides than the shown cross-section are indicated by solid lines.

In the first embodiment, the plate-shaped conductor 11 and the second main conductor 13B which was connected with the plate-shaped conductor 11 were positioned on the lower surface of the antenna substrate 5, and the line conductor 9 and the first main conductor 13A connected with the line conductor 9 were buried in the antenna substrate 5. On the other hand, in the present embodiment, conversely to the first embodiment, the plate-shaped conductor 11 and the second main conductor 13B connected with the plate-shaped conductor 11 are buried in the antenna substrate 5, and the line conductor 9 and the first main conductor 13A connected with the line conductor 9 are positioned at the lower surface of the antenna substrate 5.

From another viewpoint, between the pair of main conductors 13, one (first main conductor 13A) which is further away from the centers of the antenna substrate 5 in the z-direction and the line conductor 9 are connected, and the other (second main conductor 13B) between the pair of main conductors 13 which is closer to the centers of the antenna substrate 5 in the z-direction and the plate-shaped conductor 11 are connected.

Note that, the first facing conductor 15A which faces the first main conductor 13A and is located in the same plane as the second main conductor 13B is buried in the antenna substrate 5. The second facing conductor 15B which faces the second main conductor 13B and is located in the same plane as the first main conductor 13A is positioned at the lower surface of the antenna substrate 5. The parts other than those described above in the present embodiment are basically the same as those in the first embodiment.

As described above, in the present embodiment as well, in the same way as the first embodiment, the antenna 401 is provided with the pair of main conductors 13 and the pair of facing conductors 15 facing the pair of main conductors 13. By the arrangement of the pair of main conductors 13, pair of facing conductors 15, line conductor 9, and plate-shaped conductor 11 in the present embodiment, for example, the peak gain by right hand circular polarization becomes higher than the peak gain by left hand circular polarization.

Note that, the present embodiment may be combined with one or more among the second to eighth embodiments (however, selecting either the second and seventh embodiments and selecting either the fourth and fifth embodiments).

<Example of Utilization of Antenna>

(Assembly)

Figure 11A:
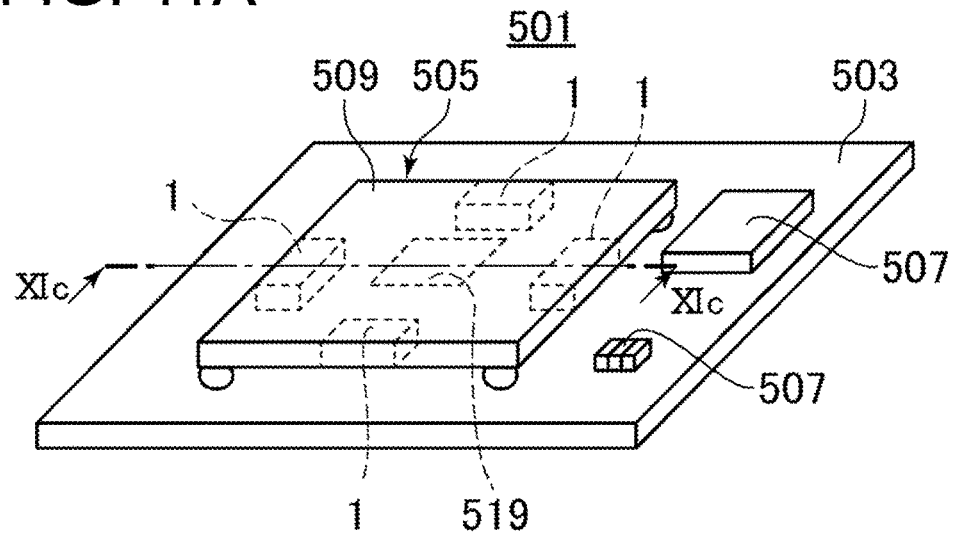
FIG. 11A and FIG. 11B are perspective views showing assemblies as examples of utilization of the antenna.
Figure 11B:
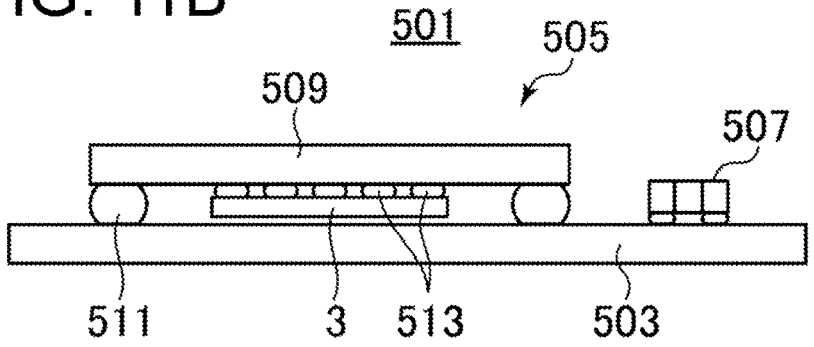

FIG. 11A is a perspective view showing an assembly 501 including the antenna 1. FIG. 11B is a side surface view of the assembly 501. Note that, in the following explanation, use will be made of notations in the antenna 1 in the first embodiment. However, in place of the antenna 1, the antenna according to the other embodiments may be provided as well.

The assembly 501 is for example included in a portable terminal or another electronic apparatus and performs communication through radio waves. The assembly 501 for example includes a main substrate 503, a module 505 including the antenna 1 and mounted on the main substrate 503 and other electronic parts 507 mounted on the main substrate 503.

The main substrate 503 is for example a rigid type printed circuit board or FPC (flexible printed circuit). Although not particularly shown, it is configured by providing wiring lines and pads etc. on an insulation substrate. The electronic parts 507 are for example an IC, resistor element, capacitor, inductor, switch, connector, or sensor. Any of these electronic parts 507 may be electrically connected through the main substrate 503 with the module 505 as well.

(Module)

The module 505 includes for example a module substrate 509 including the antenna 1 and an IC 3 which is mounted on the module substrate 509. Note that, the module 505, other than the IC 3, may be provided with an electronic part 507 mounted on the module substrate 509 as well. Unlike the illustration, the IC 3 may be connected with the antenna 1 by being mounted on a substrate other than the module substrate 509 (for example, the main substrate 503).

The module substrate 509 is for example mounted on the main substrate 503 through bumps 511 so that its major surface (the broadest surface in a plate shape, below, same is true for other substrates) is made to face the major surface of the main substrate 503. Note that, the module substrate 509 may be connected with the main substrate 503 by a method different from FIG. 11. For example, it is inserted into a connector provided on the main substrate 503.

The IC 3 is for example mounted through bumps 513 on the major surface of the module substrate 509 which faces the main substrate 503. The bumps 513 are for example interposed between not shown pads formed on the surface of the IC 3 and pads 515 of the module substrate 509 (one type of land in a broad sense, FIG. 11C) and bond them. Note that, the IC 3 may be mounted on the major surface of the module substrate 509 on the side opposite to the main substrate 503 as well. Further, the IC 3 may have leads formed so as to project out in place of the pads provided in a layered shape on its surface so that it is mounted by through-hole mounting where the leads are inserted into the module substrate 509 or is mounted by bonding of the leads and the pads 515.

(Module Substrate)

Figure 11C:
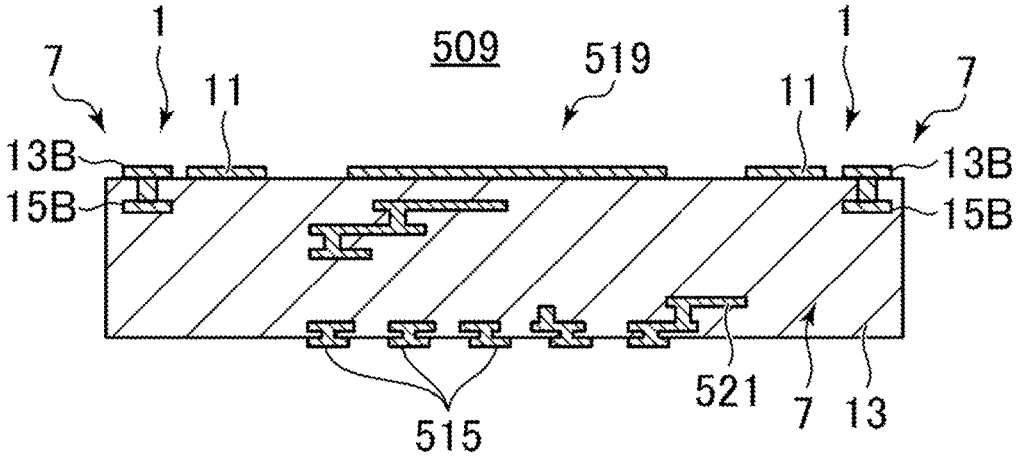
FIG. 11C is a cross-sectional view taken along the XIc-XIc line in FIG. 11A of a module substrate included in the assembly.

FIG. 11C is a cross-sectional view showing a module substrate 509 and corresponds to the XIc-XIc line in FIG. 11A.

The module substrate 509 is for example configured by a rigid type printed circuit board and has an insulation substrate 517 configured by an insulator and various conductors provided in the insulation substrate 517. The module substrate 509 is for example a multilayer substrate and includes the multilayer substrates each configuring the antenna 1 as parts thereof as shown in FIG. 11A and FIG. 11C. Accordingly, the explanation already given for the multilayer substrate configuring the antenna 1 may be applied to the explanation for the module substrate 509 except for the details.

For example, the insulation substrate 517 has a plurality of dielectric layers 21 (see FIG. 2B and FIG. 2C) which are stacked on each other. The layers in part or all of the plurality of dielectric layers 21 are utilized for configuration of the antennas 1 by parts of their regions. That is, the insulation substrate 517 includes the antenna substrates 5. Further, the conductors provided in the insulation substrate 517 are via conductors (notations are omitted) and conductor layers 23. Some are utilized for configuring the antenna conductor 7, line conductor 9, and plate-shaped conductor 11.

The module substrate 509 for example has the antennas 1 on the side-surface sides. For example, the antenna conductor 7, when viewed on a plane, is closer to the side surface of the module substrate 509 than the center in the figure of the module substrate. Further, for example, the side surface on the −y side of the antenna substrate 5 in FIG. 1 configures a portion of one side surface of the insulation substrate 517. From another viewpoint, for example, another conductor is not interposed between the antenna conductor 7 and a region in the one side surface of the insulation substrate 517 which overlaps the antenna conductor 7 when viewed in the direction perpendicular to the one side surface, or there is no another conductor on the side closer to the one side surface than the antenna conductor 7 over the entire surface of the one side surface.

Further, the module substrate 509 is for example rectangular when viewed on a plane and has the antenna 1 positioned on the side of the side surface as described above for each of its four side surfaces. These four antennas 1 for example are designed to handle radio waves having the same frequencies as each other.

Note that, the antenna 1 may be provided on the center side in the module substrate 509. The orientation in which the −y side in FIG. 1 is directed may be replaced by an orientation other than that described above in the case where the antenna 1 is provided on the center side or the side of the side surface. Further, the number of antenna 1 is a suitable one. For example, only one may be provided, they may be provided for only the two side surfaces which intersect with each other, or a larger number of antennas than those in the example shown may be provided. A plurality of antennas 1 handling frequencies which are different from each other may be provided as well.

The module substrate 509, other than the antennas 1, for example has an antenna 519, already explained pads 515, not shown pads for mounting the module substrate 509 on the main substrate 503, and wiring lines 521 for suitably connecting them. The wiring lines 521 and pads 515 (and other pads) are for example positioned closer to the center side of the insulation substrate 517 than the antenna conductor 7.

The configuration of each antenna 519 may be a suitable one. FIG. 11A and FIG. 11C illustrate a case where the antenna 519 is configured by one patch antenna. Other than this, the antenna 519 may be configured by for example a helical antenna, two dipole antennas, or an array antenna configured by a plurality of patch antennas and the like.

The pads 515 are for example configured by the conductor layer 23 positioned on the major surface of the insulation substrate 517. Note that, as the pads 515, ones for mounting electronic parts 507 other than the IC 3 may be provided as well. Further, the module substrate 509, in place of or addition to the pads 515, may have a not shown land in a narrow sense for through-hole mounting the IC 3 or other electronic parts 507 as well.

Note that, the term of "land" sometimes designates a conductor pattern for through-hole mounting (narrow sense) or sometimes designates a conductor pattern used for attachment and connection of the parts while including pads for surface-mounting (broad sense). In the present disclosure, unless indicated otherwise, the land in a broad sense is designated.

The wiring lines 521 are for example configured by via conductors (notations are omitted) and/or conductor layers 23. As the wiring lines 521, for example, one connecting the line conductor 9 with any of the plurality of pads 515, one connecting the plate-shaped conductor 11 with any other one of the plurality of pads 515, and the like are provided. Other than these, wiring lines 521 for connecting the line conductors 9 in the plurality of antennas 1 with each other and/or wiring lines 521 for connecting the plate-shaped conductors 11 in the plurality of antennas 1 with each other may be provided and the like.

(Operation of IC)

The operation of the IC 3 on the module substrate 509 is as follows.

The IC 3 for example performs modulation of a signal including information to be transmitted and raising of the frequency (conversion to a high frequency signal having a carrier frequency) and outputs the signal to the antenna 1 and/or antenna 519. In place of or addition to this operation, when receiving as input a signal from the antenna 1 and/or antenna 519, the IC 3 performs a frequency-down conversion and demodulation of the signal.

Note that, the potential when outputting the signal from the IC 3 to the antenna 1 and the potential when inputting the signal from the antenna 1 to the IC 3 are as already explained with reference to FIG. 1. Further, although not particularly shown, in the internal portion of the IC 3 or between the IC 3 and the antenna 1, filtering and amplification of signals may be suitably carried out. Further, although not particularly shown, where the antenna 1 is utilized for both transmission and reception, a duplexer is provided in the internal portion of the IC 3 or between the IC 3 and the antenna 1.

Note that, in the above embodiment, the end part 13*d* and end part 13*e* in the first main conductor 13A and the end part 13*d* and end part 13*e* in the second main conductor 13B are examples of the first end part, second end part, third end part, and fourth end part in order or examples of the third end part, fourth end part, first end part, and second end part in order. The x-direction is one example of the first direction. The z-direction is one example of the second direction. The y-direction is one example of the third direction.

EXAMPLES

A plurality of examples setting specific dimensions with respect to the antennas in the plurality of embodiments explained above were checked for gains by simulation computations. The results thereof will be shown below.

Comparative Example 1 and Examples 1 to 6

The configurations of the examples and comparative examples are as follows:

Comp. Ex. 1: Only main conductor

Comp. Ex. 2: Main conductor+expansion conductor

Ex. 1: Configuration of first embodiment (FIG. 2)

Ex. 2: Configuration of second embodiment (FIG. 3)

Ex. 3: Configuration of fourth embodiment (FIG. 5)

Ex. 4: Configuration of fifth embodiment (FIG. 6)

Ex. 5: Configuration of sixth embodiment (FIG. 7)

Ex. 6: Configuration of seventh embodiment (FIG. 8)

Comparative Example 1 is a configuration where the pair of facing conductors 15 and all connection conductors 17 are removed from the configuration in the first embodiment. Comparative Example 2 is a configuration where the pair of facing conductors 15 and all connection conductors 17 are removed from the configuration in the second embodiment. The various dimensions in Comparative Examples 1 and 2 and Examples 1 to 6 are the same as each other.

The peak gains obtained by simulation computations were as follows: The units are dBi (same true for the following description).

| | Total | Left hand circular polarization | Right hand circular polarization |
|---|---|---|---|
| Comp. Ex. 1 | 3.94 | 1.46 | 0.73 |
| Comp. Ex. 2 | 3.72 | 0.98 | 0.66 |
| Example 1 | 4.17 | 2.34 | 0.54 |
| Example 2 | 4.32 | 2.29 | 1.04 |
| Example 3 | 4.15 | 2.37 | 0.50 |
| Example 4 | 4.24 | 2.22 | 0.58 |
| Example 5 | 3.94 | 1.77 | 1.22 |
| Example 6 | 4.35 | 2.34 | 1.00 |

As described above, in all of Examples 1 to 6, compared with Comparative Example 1, the peak gain in the total gain did not fall, and the peak gain in left hand circular polarization became high. That is, the gain became high. Further, as shown by Examples 1 and 2, by providing the expansion conductors 31, the peak gain in the total gain and the peak gain in right hand circular polarization become high. Further, as shown by Comparative Examples 1 and 2, the peak gain does not become high even when the expansion conductors 31 are provided without providing the facing conductors 15.

Examples 7 to 9

The configurations in Examples 7 to 9 are as follows.

Ex. 7: Modification of first embodiment (FIG. 2)

Ex. 8: Modification of second embodiment (FIG. 3)

Ex. 9: Modification of third embodiment (FIG. 4)

Examples 7 and 8 show cases making the distance Dt1 longer relative to Examples 1 and 2 as indicated by the two-dotted chain lines in FIG. 2A. Specifically, in contrast to Examples 1 and 2 in which the distance Dt1 is about $0.3\lambda_g$, the distance Dt1 in Examples 7 and 8 is about $1.1\lambda_g$. Further, Example 9, in the same way as the third embodiment relative to the first embodiment, shows a case of forming a pair of facing conductors 115 by making the pair of facing conductors 15 shorter in Example 7.

The peak gains obtained by simulation computations are as follows:

| | | | |
|---|---|---|---|
| Example 7 | 7.62 | 5.28 | 3.96 |
| Example 8 | 8.34 | 5.81 | 4.84 |
| Example 9 | 7.62 | 5.19 | 4.00 |

As seen from a comparison of Examples 1 and 7 and a comparison of Examples 1 and 8, the peak gains of various types of circular polarizations become high by making the distances Dt1 longer. That is, the gain is improved. Further, as seen from a comparison of Examples 7 and 9, by the pair of facing conductors 15 having portions positioned on the outer sides of the main conductors 13, the peak gain in left hand circular polarization is improved. That is, the gain is improved.

Examples 10 and 11

The configurations in Examples 10 and 11 are the same as the first embodiment (FIG. 2). However, Examples 10 and 11, relative to Example 1, show cases formed by moving the pair of facing conductors 15 to the outer side in the x-direction. The order from the smallest amount by which the pair of facing conductors 15 are positioned at the outer sides of the pair of main conductors 13 is Example 1 and Examples 10 and 11.

The peak gains obtained by simulation computations are as follows.

| | | | |
|---|---|---|---|
| Example 10 | 4.19 | 2.43 | 0.34 |
| Example 11 | 4.23 | 2.52 | 0.22 |

As seen from a comparison of Examples 1, 10 and 11, the more the pair of facing conductors 15 are positioned at the outside, the higher the peak gain in the total gain and the peak gain in left hand circular polarization. That is, the gain is improved.

The present invention is not limited to the above embodiments and may be executed in various ways.

For example, the antenna may be utilized in a suitable frequency band. Specifically, it may be utilized in a frequency band of 30 kHz to 300 kHz, a frequency band of 300 kHz to 3000 kHz, a frequency band of 3 MHz to 30 MHz, a frequency band of 30 MHz to 300 MHz, a frequency band of 300 MHz to 3000 MHz, a frequency band of 3 GHz to 30 GHz, or a frequency band of 30 GHz to 300 GHz.

Further, as understood from the above description, the antenna is not limited to a relatively small-sized one. For example, an antenna in which the length of the main conductor is several tens of centimeters or more or a few meters or more may be provided in a steel tower or a building or other real estate or may be provided in a means of transport such as a ship. Further, the antenna may be provided outside the housing of the electronic apparatus with a length not less than a few centimeters or not less than several tens of centimeters.

In the embodiments, it was assumed that the antenna was made to function like a half wavelength dipole antenna and the explanation was given while making the length L1 of each of the pair of main conductors 13 as $\lambda_g/4$ in principle. However, it is possible to make the length L1 as $\lambda_g/4+n\times\lambda_g/2$ where "n" is an integer of 0 or more.

The antenna may be one not having a dielectric (first substrate or second substrate), plate-shaped conductor and/or line conductor as well. For example, the antenna need not be buried in the dielectric, but may be set in length using the wavelength in the atmosphere as the reference. For example, the antenna need not be provided with a plate-shaped conductor, but may use the ground, car body, or housing in place of the plate-shaped conductor. Further, for example, the line conductor may be provided at an external portion of the antenna as well.

Further, the antenna substrate need not be provided with the second dielectric layer 21B either. That is, the line conductor 9 may be exposed. Further, the conductor layer of the line conductors 9 etc. may be coated by an insulation layer made of resist or another resin material or SiOx or another inorganic material.

When at least a portion of the antenna conductor is buried in the dielectric, the antenna is not limited to one configured by a multilayer substrate. For example, the antenna may be configured by injecting an uncured dielectric into a mold in which conductors are arranged. Further, the shape of the dielectric is not limited to a substrate shape.

The transmission line is not limited to a microstrip line and may be a coaxial cable or a strip line with conductor layers positioned on the two sides of a linear conductor. The signal is not limited to one comprised of the reference potential and a potential fluctuating relative to the reference potential. It may be one comprised of potentials having inverse polarities to each other.

The shape of the main conductor is not limited to a shape with the first direction (x-direction) as the long direction when viewed in the second direction (z-direction). For example, the main conductor may be square, a regular polygon, or circular. Further, the shape with the first direction as the long direction is not limited to a rectangular shape. For example, the shape with the first direction as the long direction may be oval, elliptical (a shape where the short sides of a rectangular shape are formed in circular arcs), or suitably polygonal.

The positions in the second direction (z-direction) of the pair of main conductors may be the same as each other. Further, in both of the mode in which the positions in the second direction of the pair of main conductors are different from each other and the mode in which they are the same as each other, the positions in the second direction of the pair of facing conductors may be different from each other and may be the same as each other. Further, from another viewpoint, the pair of main conductors and the pair of facing conductors may be provided over three or more layers as well. In the embodiments and various modes concerning the positions in the second direction of the pair of main conductors and pair of facing conductors as described above, the positions in the second direction of the pair of expansion conductors may be different from each other or the same as each other. Note that, as already explained, the positions in the z-direction of the expansion conductors may be different from those of the main conductors and facing conductors.

The antenna conductor need not be rotation symmetrically shaped by 180° either. For example, it may be linear symmetrically shaped by making the positions in the second direction (z-direction) of the pair of main conductors the same and making the positions in the z-direction of the pair of facing conductors the same. For example, it may be linear symmetrically shaped with respect to the connection line 19. Further, the symmetry may be broken for fine adjustment of the gain as well.

The first direction, the second direction, and the third direction need not be perpendicular to each other. For example, the intersecting angles of these directions may be finely adjusted from perpendicular angles so that the gain is improved.

Further, there may be a plurality of antenna conductors. Specifically, a plurality of antenna conductors may be arranged at intervals from each other in the x-direction so as form an array.

A configuration making the distance from the main conductors up to the end face of the dielectric relatively long contributes to improvement of the gain even in a case where no facing conductors and expansion conductors are provided. Accordingly, for example, the facing conductors may be omitted in FIG. 1 as well. Further, for example, the following art can be derived from the present disclosure.

An antenna including:

a first main conductor including a first end part and a second end part which is located on one side of a first direction relative to the first end part, a dielectric in an internal portion or on a surface of which the first main conductor is located, a plate-shaped conductor which is located in the internal portion or on the surface of the dielectric, and a line conductor which is located in the internal portion or on the surface of the dielectric, faces the plate-shaped conductor through the dielectric, and extends along the plate-shaped conductor, wherein the first main conductor is located closer to one side of a predetermined direction intersecting with the first direction than the plate-shaped conductor and the line conductor, and a distance from the first main conductor to an end face on the one side of the predetermined direction of the dielectric is the same as or longer than a length in the first direction of the first main conductor (or $\frac{1}{4}\lambda_g$).

This antenna is not limited to a dipole antenna and may be for example a monopole antenna.

REFERENCE SIGNS LIST

1 . . . antenna, 13A . . . first main conductor, 13B . . . second main conductor, 13*d* . . . end part, 13*e* . . . end part, 15A . . . first facing conductor, and 15B . . . second facing conductor.

The invention claimed is:

1. An antenna, comprising:

a first main conductor comprising a first end part and a second end part which is located on one side of a first direction relative to the first end part, a second main conductor comprising a third end part adjacent to the first end part and a fourth end part which is located on the other side of the first direction relative to the third end part, a first facing conductor which faces the first main conductor in a second direction intersecting with the first direction, a second facing conductor which faces the second main conductor in the second direction, a dielectric, a plate-shaped conductor which is located in the internal portion of the dielectric, and a line conductor which is located on the surface of the dielectric, faces the plate-shaped conductor through the dielectric, and extends along the plate-shaped conductor, wherein the first and second main conductors and the first and second facing conductors are layered conductors which are perpendicular to the second direction, and the first main conductor and the second main conductor are positioned and shaped substantially rotation symmetrically by 180° relative to each other about a symmetrical axis parallel to the line conductor.

2. The antenna according to claim 1;

wherein the first facing conductor comprises a portion located closer to the one side of the first direction than the first main conductor, and the second facing conductor comprises a portion located closer to the other side of the first direction than the second main conductor.

3. The antenna according to claim 1, further comprising at least one connection conductor connecting the first main conductor and the first facing conductor, and at least one second connection conductor connecting the second main conductor and the second facing conductor, wherein the plate-shaped conductor is connected to one of the first and second main conductors, and the line conductor is connected to the other of the first and second main conductors, each of the first and second main conductor and the first and second facing conductors comprises a shape with the first direction as a long directions, the at least one first connection conductor comprises one separated from two ends of the first facing conductor in the first direction, and the at least one second connection conductor comprises one separated from two ends of the second facing conductor in the first direction.

4. The antenna according to claim 1, further comprising a plurality of first connection conductors connecting the first main conductor and the first facing conductor and a plurality of second connection conductors connecting the second main conductor and the second facing conductor, wherein each of the first and second main conductors and the first and second facing conductors comprises a shape with the first direction as a long direction, the plurality of first connection conductors are different from each other in positions in the first direction, and the plurality of second connection conductors are different from each other in positions in the first direction.

5. The antenna according to claim 1, further comprising a first expansion conductor which is located closer to one side of a third direction intersecting with the first and second directions than the first main conductor and the first facing conductor and a second expansion conductor which is located closer to the one side of the third direction than the second main conductor and the second facing conductor.

6. The antenna according to claim 5, wherein:

the second direction is perpendicular to the first direction, the third direction is perpendicular to the first and second directions, in the first expansion conductor, when viewed in the third direction, at least a portion is located in a range from the first end part to the second end part in the first direction and located in a range from the first main conductor to the first facing conductor in the second direction, and in the second expansion conductor, when viewed in the third direction, at least a portion is located in a range from the third end part to the fourth end part in the first direction and located in a range from the second main conductor to the second facing conductor in the second direction.

7. The antenna according to claim 1, wherein:

the second direction is perpendicular to the first direction, the first and second main conductors are different from each other in positions in the second direction, the first main conductor and the second facing conductor are the same as each other in positions in the second direction, and the second main conductor and the first facing conductor are the same as each other in positions in the second direction.

8. The antenna according to claim 1, wherein:

the second direction is perpendicular to the first direction.

9. The antenna according to claim 1, wherein the first and second main conductors and the first and second facing conductors are located in the internal portion or on the surface of the dielectric.

10. The antenna according to claim 9, wherein:

the first main conductor is located in the internal portion of the dielectric, the second main conductor is located on the surface of the dielectric, the first facing conductor is located on the surface of the dielectric, and the second facing conductor is located in the internal portion of the dielectric.

11. The antenna according to claim 9, wherein the one of the first and second main conductors which is closer to a center of the dielectric in the second direction and the line conductor are connected, and the one of the first and second main conductors which is further away from the center of the dielectric in the second direction and the plate-shaped conductor are connected.

12. The antenna according to claim 9, wherein the first and second main conductors are located closer to one side of a predetermined direction intersecting with the first direction and second direction than the plate-shaped conductor and the line conductor, and a distance from the first and second main conductors to an end face of the dielectric on the one side of the predetermined direction is the same as or longer than a length of the first or second main conductor in the first direction.

13. A module substrate, comprising:

the antenna according to claim 9, an insulation substrate comprising the dielectric, and a land on a surface of the insulation substrate.

14. A module, comprising the module substrate according to claim 13 and an electronic part mounted on the land.

15. The antenna according to claim 1, further comprising at least one connection conductor connecting the first main conductor and the first facing conductor, at least one second connection conductor connecting the second main conductor and the second facing conductor.

16. An antenna, comprising:

a first main conductor comprising a first end part and a second end part which is located on one side of a first direction relative to the first end part, a second main conductor comprising a third end part adjacent to the first end part and a fourth end part which is located on the other side of the first direction relative to the third end part, a first facing conductor which faces the first main conductor in a second direction intersecting with the first direction, a second facing conductor which faces the second main conductor in the second direction, a plurality of first connection conductors connecting the first main conductor and the first facing conductor, a plurality of second connection conductors connecting the second main conductor and the second facing conductor, wherein each of the first and second main conductor and the first and second facing conductors comprises a shape with the first direction as a long direction, the plurality of first connection conductors are different from each other in positions in the first direction, and the plurality of second connection conductors are different from each other in positions in the first direction.

17. The antenna according to claim 16, further comprising;

a plate-shaped conductor which is connected to one of the first and second main conductors, and a line conductor which is connected to the other of the first and second main conductors, faces the plate-shaped conductor, and extends along the plate-shaped conductor, wherein the plurality of first connection conductors comprise one separated from two ends of the first facing conductor in the first direction, and the plurality of second connection conductors comprise one separated from two ends of the second facing conductor in the first direction.

18. An antenna, comprising:

a first main conductor comprising a first end part and a second end part which is located on one side of a first direction relative to the first end part, a second main conductor comprising a third end part adjacent to the first end part and a fourth end part which is located on the other side of the first direction relative to the third end part, a first facing conductor which faces the first main conductor in a second direction intersecting with the first direction, a second facing conductor which faces the second main conductor in the second direction, a plurality of first connection conductors connecting the first main conductor and the first facing conductor, and a plurality of second connection conductors connecting the second main conductor and the second facing conductor, wherein the first and second main conductors and the first and second facing conductors are layered conductors which are perpendicular to the second direction, each of the first and second main conductors and the first and second facing conductors comprises a shape with the first direction as a long direction, the plurality of first connection conductors are different from each other in positions in the first direction, and the plurality of second connection conductors are different from each other in positions in the first direction.

* * * * *